US011594820B2

(12) United States Patent
Foo

(10) Patent No.: US 11,594,820 B2
(45) Date of Patent: Feb. 28, 2023

(54) COMPOSITE RIGHT LEFT HANDED (CRLH) MAGNETOELECTRIC UNIT-CELL BASED STRUCTURE FOR ANTENNA AND SYSTEM

(71) Applicant: HUAWEI TECHNOLOGIES CO., LTD., Guangdong (CN)

(72) Inventor: Senglee Foo, Ottawa (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 222 days.

(21) Appl. No.: 17/067,494

(22) Filed: Oct. 9, 2020

(65) Prior Publication Data

US 2022/0115786 A1 Apr. 14, 2022

(51) Int. Cl.

| | |
|---|---|
| ***H01Q 9/04*** | (2006.01) |
| ***H01Q 1/48*** | (2006.01) |
| ***H01Q 1/24*** | (2006.01) |
| ***H01Q 3/36*** | (2006.01) |
| ***H01Q 1/52*** | (2006.01) |

(52) U.S. Cl.

CPC ..... *H01Q 9/0457* (2013.01); *H01Q 1/243* (2013.01); *H01Q 1/48* (2013.01); *H01Q 1/523* (2013.01); *H01Q 3/36* (2013.01); *H01Q 9/0421* (2013.01)

(58) Field of Classification Search

CPC ... H01Q 15/006; H01Q 9/0421; H01Q 9/0457
See application file for complete search history.

(56) References Cited

U.S. PATENT DOCUMENTS

2010/0225554 A1 9/2010 Huang et al.
2010/0231464 A1 9/2010 Huang et al.
2015/0130673 A1* 5/2015 Ng ..... H01Q 15/008 716/122
2017/0187123 A1* 6/2017 Black ..... H01Q 13/26

FOREIGN PATENT DOCUMENTS

CN 102341959 A 2/2012
CN 105379152 A 3/2016

OTHER PUBLICATIONS

International Search Report and Written Opinion issued in co-pending International application No. PCT/CN2021/122852 dated Jan. 6, 2022.

* cited by examiner

*Primary Examiner* — Ricardo I Magallanes
(74) *Attorney, Agent, or Firm* — BCF LLP

(57) ABSTRACT

The disclosed systems, structures, and methods are directed to an antenna comprising: a plurality of Composite Right Left Handed (CRLH) magneto-electric unit-cell based structures, each CRLH magneto-electric unit-cell based structure comprising: a ground electrode for common electrical contacts, a first coaxial connector and a second coaxial connector, a first ground surface and a second ground surface, the first ground surface connected to a second end of the first coaxial connector and the second ground surface connected to a second end of the second coaxial connector, a coaxial line included in the second coaxial connector, a microstrip feed line connected to the coaxial line and electromagnetically coupled with the first and the second ground surfaces, and a first non-resonant meta-surface patch and a second non-resonant meta-surface patch, each of the first and second non-resonant meta-surface patches placed above a series-capacitor gap between the first ground surface and the second ground surface.

20 Claims, 25 Drawing Sheets

300

400

500

802

1000

1100

1300

1400

COMPOSITE RIGHT LEFT HANDED (CRLH) MAGNETOELECTRIC UNIT-CELL BASED STRUCTURE FOR ANTENNA AND SYSTEM

CROSS-REFERENCE TO RELATED APPLICATIONS

This is the first application filed for the instantly disclosed technology.

FIELD OF THE INVENTION

The present invention generally relates to antenna structure and, in particular, to a Composite Right Left Handed (CRLH) magneto-electric unit-cell based structure for antenna and system.

BACKGROUND

One of the requirements for future cellular communications (e.g. 5G communication networks) is the provision of antennas that include low-profile phased arrays with extremely wide frequency bandwidth and wide angular scanning range. However, conventional phased arrays comprising multiple resonant radiating elements tends to have limited frequency bandwidth due to inherent bandwidth limitations of resonant radiating elements.

To overcome the problem of bandwidth limitation, a concept of connected arrays or tightly coupled dipole array, has been widely explored. The concept uses closely spaced dipoles to approximate continuous Wheeler current sheet for ultra-wideband performance. Such arrays are capable of operating over a very broad bandwidth and over a wide-scan angular volume. However, tightly coupled dipole array assumes an idealized delta-gap between closely spaced dipole sources as excitation.

It is to be noted that performance of such arrays relies on the realization of a broadband complex feed network, which is typically problematic and requires very long design cycles. Furthermore, coupling between radiating elements of this type of array is relatively high due to closely spaced elements. As a result, efficiency of such arrays often falls quickly over frequency bandwidth as beam scanning angle increases. To this end, there is an interest in developing a low-cost antenna structure with a low profile and low-complexity feed network.

SUMMARY

The present disclosure generally provides an antenna comprising: a plurality of Composite Right Left Handed (CRLH) magneto-electric unit-cell based structures, each CRLH magneto-electric unit-cell based structure comprising: a ground electrode for common electrical contacts; a first coaxial connector and a second coaxial connector, a first end of the first coaxial connector and a first end of the second coaxial connector connected to the ground electrode; a first ground surface and a second ground surface, the first ground surface connected to a second end of the first coaxial connector and the second ground surface connected to a second end of the second coaxial connector; a coaxial line included in the second coaxial connector; a microstrip feed line connected to the coaxial line and electromagnetically coupled with the first and the second ground surfaces; and a first non-resonant meta-surface patch and a second non-resonant meta-surface patch, each of the first and second non-resonant meta-surface patches printed on a dielectric material and placed above a series-capacitor gap between the first ground surface and the second ground surface and electromagnetically coupled to the first ground surface and the second ground surface.

In accordance with other aspects of the present disclosure, the antenna, wherein the first coaxial connector includes a second coaxial line.

In accordance with other aspects of the present disclosure, the antenna, wherein a radio frequency signal traversing in the microstrip feed line induces a tangential electric field in the series-capacitor gap resulting in a magnetic radiating source; the radio frequency signal induces an electric current in the microstrip feed line and the first ground surfaces resulting in an electric radiating source; and the magnetic radiating source and the electric radiating source form a magnetic-electric radiating element.

In accordance with other aspects of the present disclosure, the antenna, wherein the plurality of CRLH magneto-electric unit-cell based structures are separated from each other by a distance less than $\lambda/2$, where $\lambda$ is a wavelength of a radio frequency signal fed to the microstrip feed line via the coaxial line.

In accordance with other aspects of the present disclosure, the antenna, wherein a width of the first non-resonant meta-surface patch and the second non-resonant meta-surface patch is less than $\lambda/2$, where $\lambda$ is a wavelength of a radio frequency signal fed to the microstrip feed line via the coaxial line.

In accordance with other aspects of the present disclosure, the antenna, wherein the first coaxial connector and the second coaxial connector are separated from each other by a distance less than $\lambda/2$, where $\lambda$ is a wavelength of a radio frequency signal fed to the microstrip feed line via the coaxial line.

In accordance with other aspects of the present disclosure, the antenna, wherein the first ground surface and the second ground surface have a tuning slot for RF tuning.

In accordance with other aspects of the present disclosure, the antenna, wherein the ground electrode is a ground perfect electric conductor.

In accordance with other aspects of the present disclosure, the antenna, wherein the plurality of CRLH magneto-electric unit-cell based structures are arranged as one-dimensional phased array structure.

In accordance with other aspects of the present disclosure, the antenna, wherein the plurality of CRLH magneto-electric unit-cell based structures are arranged as two-dimensional phased array structure.

In accordance with other aspects of the present disclosure, the antenna, wherein the first ground surface and second ground surface are arranged as a bow-tie capacitive structure.

In accordance with other aspects of the present disclosure, the antenna, wherein the first coaxial connector and the second coaxial connector are arranged as a shunt inductor structure.

In accordance with other aspects of the present disclosure, the antenna, wherein the plurality of CRLH magneto-electric unit-cell based structures are operated in evanescent mode.

In accordance with other aspects of the present disclosure, the antenna, wherein the first non-resonant meta-surface patch and the second non-resonant meta-surface patch provide impedance matching.

In accordance with other aspects of the present disclosure, the antenna is configured to provide a scan range of +/−50 deg.

In accordance with other aspects of the present disclosure, the antenna, is configured to provide a bandwidth up to 65 GHz.

In accordance with other broad aspects of the present disclosure there is provided a wireless communication device comprising: an antenna structure for receiving and transmitting wireless signals, the antenna structure comprising: a plurality of Composite Right Left Handed (CRLH) magneto-electric unit-cell based structures, where each CRLH magneto-electric unit-cell based structure comprises: a ground electrode for common electrical contacts; a first coaxial connector and a second coaxial connector, a first end of the first coaxial connector and a first end of the second coaxial connector connected to the ground electrode; a first ground surface and a second ground surface connected to a second end of the first coaxial connector and a second end of the second coaxial connector respectively; a coaxial line included in the second coaxial connector; a microstrip feed line connected to the coaxial line and electromagnetically coupled with the first and the second ground surfaces; and a first non-resonant meta-surface patch and a second non-resonant meta-surface patch disposed on a dielectric material and placed above a series-capacitor gap between the first ground surface and the second ground surface and electromagnetically coupled to the first ground surface and the second ground surface.

In accordance with other aspects of the present disclosure, the wireless communication device, wherein the first coaxial connector includes a second coaxial line.

In accordance with other broad aspects of the present disclosure there is provided a method of forming an antenna structure comprising: forming a plurality of Composite Right Left Handed (CRLH) magneto-electric unit-cell based structures, where forming each CRLH magneto-electric unit-cell based structure comprises: forming a ground electrode for common electrical contacts; forming a first coaxial connector and a second coaxial connector, a first end of the first coaxial connector and a first end of the second coaxial connector are connected to the ground electrode; forming a first ground surface and a second ground surface connected to a second end of the first coaxial connector and a second end of the second coaxial connector respectively; forming a coaxial line included in the second coaxial connector; forming a microstrip feed line connected to the coaxial line and electromagnetically coupled with the first and the second ground surfaces; and forming a first non-resonant meta-surface patch and a second non-resonant meta-surface patch disposed over a dielectric material and placed above a series-capacitor gap between the first ground surface and the second ground surface and electromagnetically coupled to the first ground surface and the second ground surface.

In accordance with other aspects of the present disclosure, the method of forming an antenna structure further comprises forming a second coaxial line included in the first coaxial connector.

BRIEF DESCRIPTION OF THE FIGURES

Further features and advantages of the present disclosure will become apparent from the following detailed description, taken in combination with the appended drawings, in which.

Figure 1:
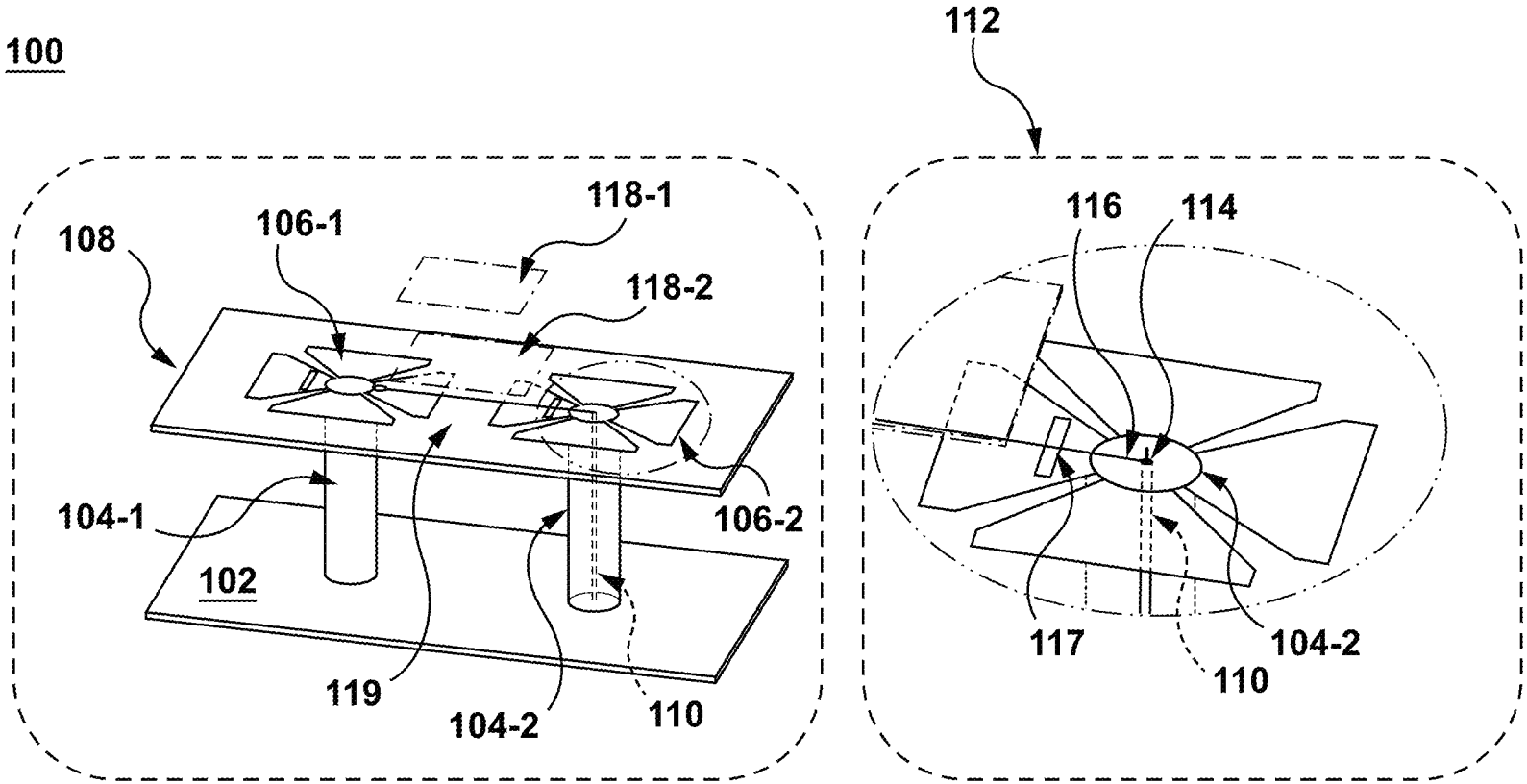
FIG. 1 depicts an isometric view of an example of high-level structural diagram of a Composite Right Left Handed (CRLH) magneto-electric unit-cell based structure, in accordance with various embodiments of the present disclosure.

It is to be understood that throughout the appended drawings and corresponding descriptions, like features are identified by like reference characters. Furthermore, it is also to be understood that the drawings and ensuing descriptions are intended for illustrative purposes only and that such disclosures do not provide a limitation on the scope of the claims.

DETAILED DESCRIPTION

The instant disclosure is directed to address at least some of the deficiencies of the current technology. In particular, the instant disclosure describes a Composite Right Left Handed (CRLH) magneto-electric unit-cell based structure for antenna and system.

In the context of directional references described herein such as "front", "rear", "up", "down", "horizontal", "top", "bottom", "side" and the like are used purely for convenience of description and do not limit the scope of the present disclosure. Furthermore, any dimensions provided herein are presented merely by way of an example and unless otherwise specified do not limit the scope of the disclosure. Furthermore, geometric terms such as "straight", "flat", "curved", "point" and the like are not intended to limit the disclosure any specific level of geometric precision, but should instead be understood in the context of the disclosure, taking into account normal manufacturing tolerances, as well as functional requirements as understood by a person skilled in the art.

In the context of the present specification, unless provided expressly otherwise, the words "first", "second", "third", etc. have been used as adjectives only for the purpose of allowing for distinction between the nouns that they modify from one another, and not for the purpose of describing any particular relationship between those nouns. Thus, for example, it should be understood that, the use of the terms "first processor" and "third processor" is not intended to imply any particular order, type, chronology, hierarchy or ranking (for example) of/between the server, nor is their use (by itself) intended to imply that any "second server" must necessarily exist in any given situation. Further, as is discussed herein in other contexts, reference to a "first" element and a "second" element does not preclude the two elements from being the same actual real-world element. Thus, for example, in some instances, a "first" server and a "second" server may be the same software and/or hardware, in other cases they may be different software and/or hardware.

It will be understood that when an element is referred to as being "connected" or "coupled" to another element, it can be directly or indirectly connected or coupled to the other element or intervening elements that may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is only intended to describe particular representative embodiments and is not intended to be limiting of the present technology. As used herein, the singular forms "a," "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

Implementations of the present technology each have at least one of the above-mentioned objects and/or aspects, but do not necessarily have all of them. It should be understood that some aspects of the present technology that have resulted from attempting to attain the above-mentioned object may not satisfy this object and/or may satisfy other objects not specifically recited herein.

The examples and conditional language recited herein are principally intended to aid the reader in understanding the principles of the present technology and not to limit its scope to such specifically recited examples and conditions. It will be appreciated that those skilled in the art may devise various arrangements which, although not explicitly described or shown herein, nonetheless embody the principles of the present technology and are included within its spirit and scope.

Furthermore, as an aid to understanding, the following description may describe relatively simplified implementations of the present technology. As persons skilled in the art would understand, various implementations of the present technology may be of a greater complexity.

In some cases, what are believed to be helpful examples of modifications to the present technology may also be set forth. This is done merely as an aid to understanding, and, again, not to define the scope or set forth the bounds of the present technology. These modifications are not an exhaustive list, and a person skilled in the art may make other modifications while nonetheless remaining within the scope of the present technology. Further, where no examples of modifications have been set forth, it should not be interpreted that no modifications are possible and/or that what is described is the sole manner of implementing that element of the present technology.

Moreover, all statements herein reciting principles, aspects, and implementations of the present technology, as well as specific examples thereof, are intended to encompass both structural and functional equivalents thereof, whether they are currently known or developed in the future. Thus, for example, it will be appreciated by those skilled in the art that any block diagrams herein represent conceptual views of illustrative circuitry embodying the principles of the present technology. Similarly, it will be appreciated that any flowcharts, flow diagrams, state transition diagrams, pseudo-code, and the like represent various processes which may be substantially represented in computer-readable media and so executed by a computer or processor, whether or not such computer or processor is explicitly shown.

The functions of the various elements shown in the figures, including any functional block labeled as a "processor" or a "graphics processing unit", may be provided through the use of dedicated hardware as well as hardware capable of executing software in association with appropriate software. When provided by a processor, the functions may be provided by a single dedicated processor, by a single shared processor, or by a plurality of individual processors, some of which may be shared. In some embodiments of the present technology, the processor may be a general purpose processor, such as a central processing unit (CPU) or a processor dedicated to a specific purpose, such as a graphics processing unit (GPU). Moreover, explicit use of the term "processor" or "controller" should not be construed to refer exclusively to hardware capable of executing software, and may implicitly include, without limitation, digital signal processor (DSP) hardware, network processor, application specific integrated circuit (ASIC), field programmable gate array (FPGA), read-only memory (ROM) for storing software, random access memory (RAM), and non-volatile storage. Other hardware, conventional and/or custom, may also be included.

Software modules, or simply modules, or units which are implied to be software, may be represented herein as any combination of flowchart elements or other elements indicating performance of process steps and/or textual description. Such modules may be executed by hardware that is expressly or implicitly shown.

With these fundamentals in place, the instant disclosure is directed to address at least some of the deficiencies of the current technology. In particular, the instant disclosure describes a CRLH magneto-electric unit-cell based structure for antenna and system.

As previously discussed, the concept of connected arrays, or tightly coupled dipole arrays uses closely spaced dipoles to approximate continuous Wheeler current sheet for ultra-wideband performance. Although, such arrays are capable of operating over a very broad bandwidth and over a wide-scan angular volume, performance of such arrays relies on the realization of a broadband complex feed network. To this end, the present disclosure discloses an alternative ultra-wideband phased array concept based on Composite Right Left Handed (CRLH) transmission structure operated in evanescent-mode that provides a low-cost antenna structure with a low profile and low-complexity feed network. In so doing, surface wave propagation between magnetic-electric radiating elements of the phased array is controlled through evanescent-mode propagation in a CRLH transmission structure. The CRLH transmission structure-based phased array allows a limited or weak coupling among CRLH unit cells, which results in ultra-wideband operations.

Further to the ultra-wideband operations, the CRLH transmission structure-based phased array also provides a wide angular scanning range. In certain embodiments, the array structure may be a series of magneto-electric radiators that are a combination of alternating linear dipole and stacked patches. The dipole array produces a continuous electric current and the slot-patch array produces a series of magnetic current. This type of array structure is capable of providing flexible beam scanning with relatively wide scanning angle over an extremely wide frequency bandwidth and with high radiation efficiency.

With this said, FIG. 1 depicts an isometric view of an example of high-level structural diagram of a CRLH magneto-electric unit-cell based structure 100, in accordance with various embodiments of the present disclosure. It is to be noted that the CRLH magneto-electric unit-cell based structure 100 may include two CRLH magneto-electric unit-cells. It is to be noted that various implementations of the present disclosure may include a plurality of CRLH magneto-electric unit-cell based structures 100 arranged in one or two dimensions. As shown, the CRLH magneto-electric unit-cell based structure 100 may include a ground electrode 102 for common electrical contacts. In certain embodiments, the ground electrode 102 may be a ground perfect electric conductor (PEC). In this context, "perfect electric conductor" means that the conductivity of the material used to create the ground electrode is sufficient to provide substantially equal potential throughout, with sheet resistance low enough to be negligible compared to other effects.

The CRLH magneto-electric unit-cell based structure 100 further includes a first coaxial connector 104-1 and a second coaxial connector 104-2 (also referred to as coax tubes). In certain embodiments, an outer shield of the two coaxial connectors 104-1 and 104-2 may act as shunt inductors. The bottom of the two coaxial connectors 104-1 and 104-2 may be connected to the ground electrode 102 and the top may be connected to ground surfaces 106-1 and 106-2 respectively. In certain embodiments, the ground surfaces 106-1 and 106-2 may be designed as bow-tie shaped caps. Further, in certain embodiments, each of the ground surfaces 106-1 and 106-2 may symmetrically surround the two coaxial connectors 104-1 and 104-2 respectively. In yet further embodiments, the two ground surfaces 106-1 and 106-2 may be supported by a dielectric substrate 108. It is to be noted that the first coaxial connector 104-1 and the ground surface 106-1 may represent first CRLH magneto-electric unit-cell and the second coaxial connector 104-2 and the ground surface 106-2 may represent second CRLH magneto-electric unit-cell.

In certain embodiments, the two coaxial connectors 104-1 and 104-2 may include polytetrafluoroethylene (PTFE) filled coaxial lines. For the purpose of simplicity, only the coaxial connector 104-2 has been illustrated with the PTFE filled coaxial line 110. As shown in enlarged view 112 of a portion of the CRLH magneto-electric unit-cell based structure 100, the PTFE filled coaxial line 110 includes a central conductor 114, in which a microstrip feed line 116 may be connected to the central conductor 114. The microstrip feed line 116 may traverse through the series-capacitor gap 119 between the two ground surfaces 106-1 and 106-2. It is to be noted that the far end of the microstrip feed line 116 may not be physically connected to the coaxial connector 104-1 and the two ground surfaces 106-1 and 106-2. Rather, the microstrip feed line 116 may be electromagnetically coupled to the coaxial connector 104-1 and the two ground surfaces 106-1 and 106-2. In certain embodiments, each of the ground surfaces 106-1 and 106-2 may have a tuning slot 117 for radio frequency (RF) tuning.

It is to be noted that a similar arrangement (not illustrated in the FIG. 1) may be associated with the coaxial connector 104-1. The coaxial connector 104-1 may also include the PTFE filled coaxial line with the central conductor to which the microstrip feed line may be connected to the central conductor. Such microstrip feed line may traverse through the series-capacitor gap between the ground surface 106-1 and a similar ground surface placed at a distance less than $\lambda/2$ to the left of the coaxial connector 104-1.

The CRLH magneto-electric unit-cell based structure 100 further includes a non-resonant meta-surface top patch 118-1 and a non-resonant meta-surface bottom patch 118-2. The two patches 118-1 and 118-2 are not directly connected with each other nor are they connected to the ground surfaces 106-1 and 106-2. Also, in certain embodiments, the two patches 118-1 and 118-2 may be disposed, i.e. by printing, evaporation, or electroplating, etc., on a dielectric material.

Figure 2:
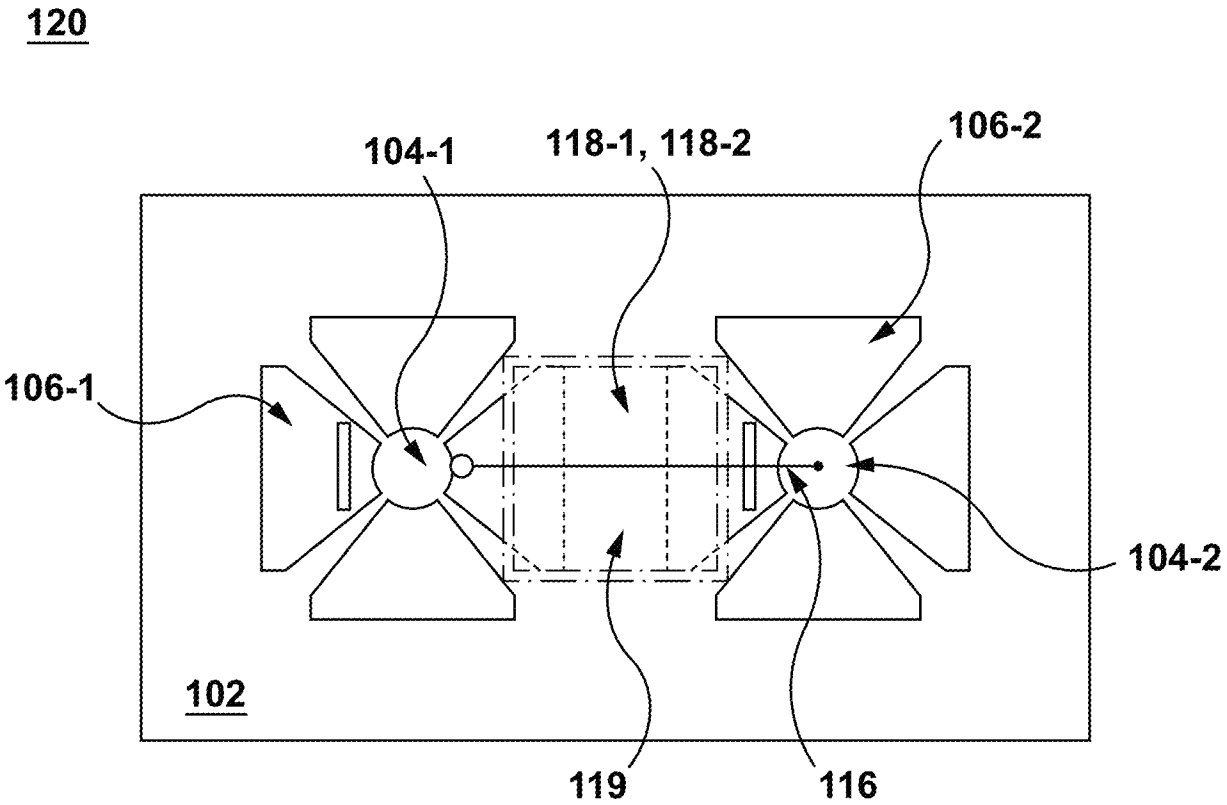
FIG. 2 depicts a top view of an example of high-level structural diagram of the CRLH magneto-electric unit-cell based structure, in accordance with various embodiments of the present disclosure.
Figure 3:
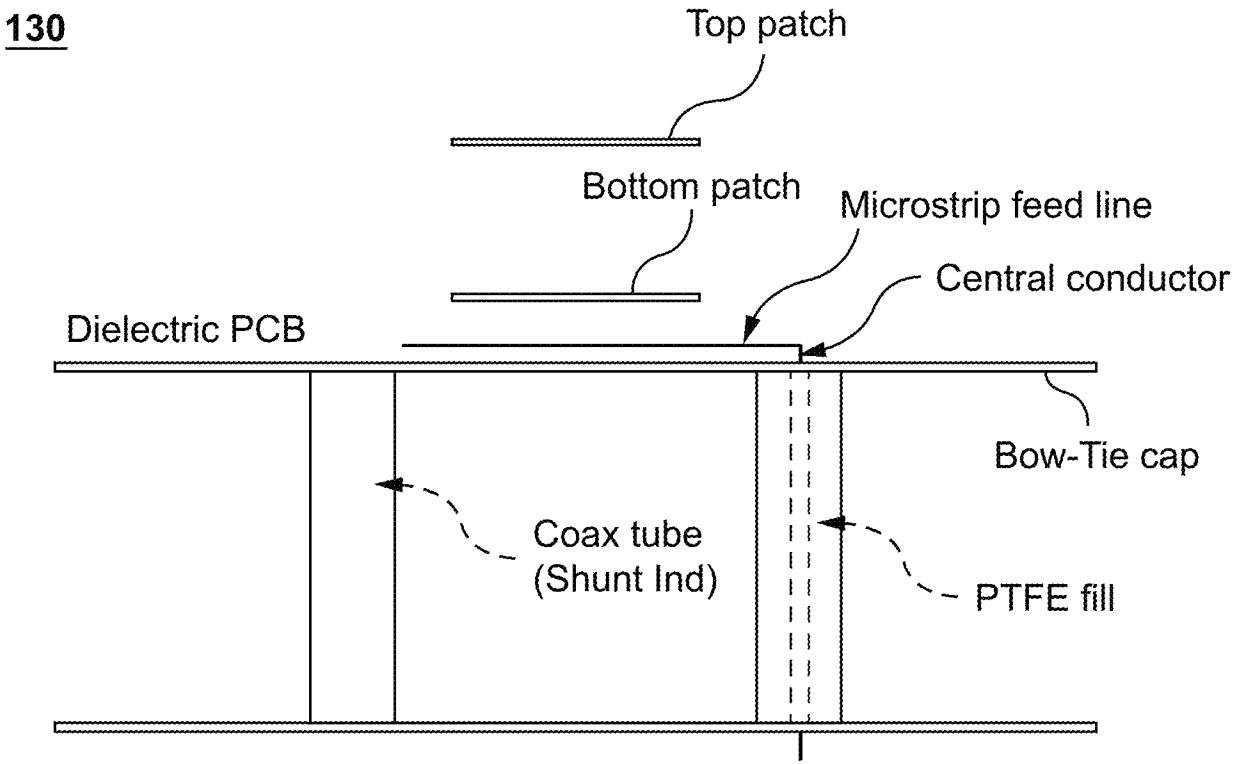
FIG. 3 depicts a side view of an example of high-level structural diagram of the CRLH magneto-electric unit-cell based structure, in accordance with various embodiments of the present disclosure.

FIG. 2 depicts a top view 120 of an example of high-level structural diagram of the CRLH magneto-electric unit-cell based structure 100, in accordance with various embodiments of the present disclosure. FIG. 3 depicts a side view 130 of an example of high-level structural diagram of the CRLH magneto-electric unit-cell based structure 100, in accordance with various embodiments of the present disclosure.

Figure 4:
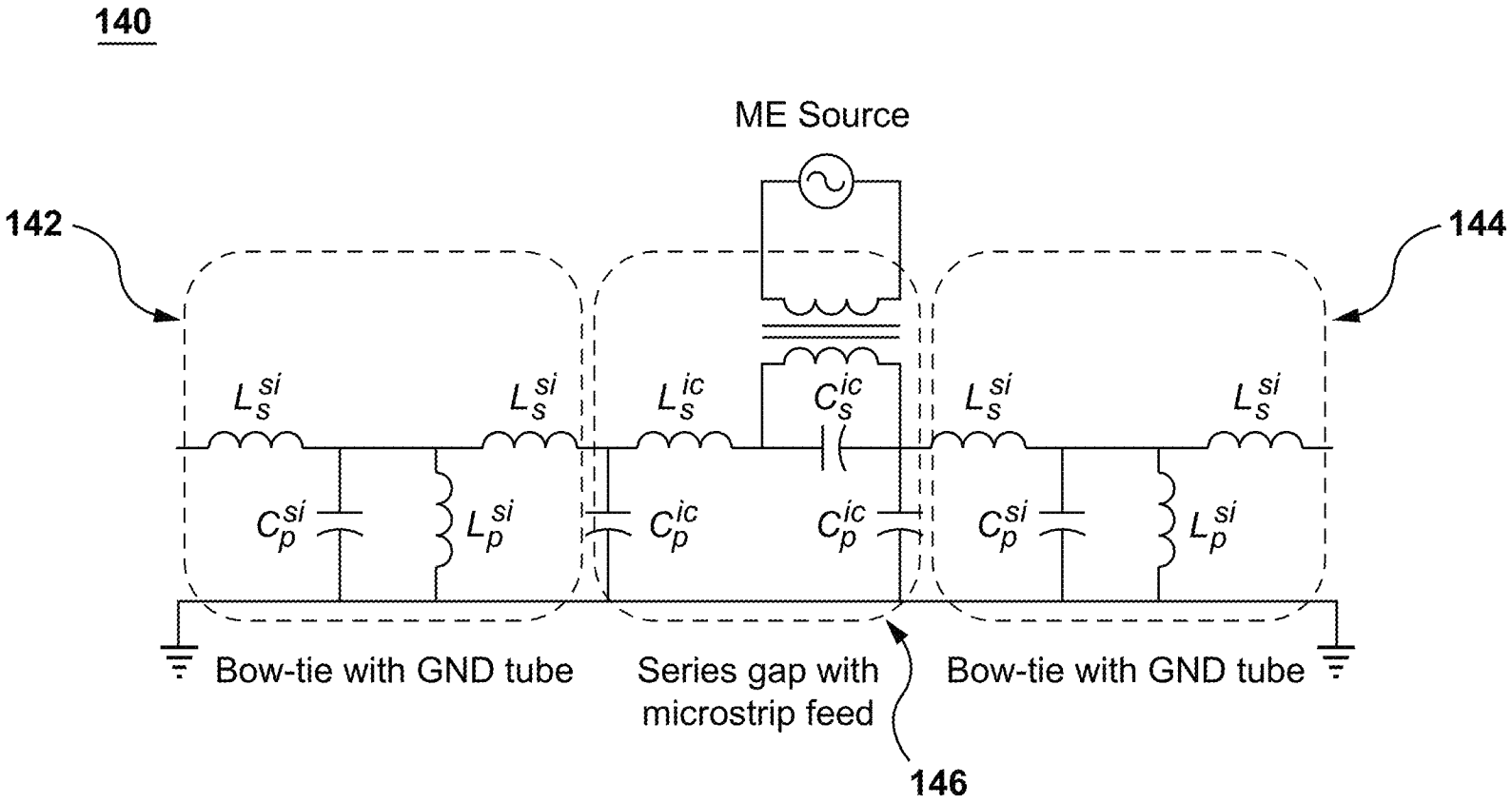
FIG. 4 depicts an equivalent circuit diagram of the CRLH magneto-electric unit-cell based structure, in accordance with various embodiments of present disclosure.

FIG. 4 depicts an equivalent circuit diagram 140 of the CRLH magneto-electric unit-cell based structure 100, in accordance with various embodiments of present disclosure. In particular, the left portion of the equivalent circuit diagram 140 may represent an equivalent circuit diagram 142 associated with the ground surface 106-1, the coaxial connector 104-1, and the ground electrode 102. The right portion of the equivalent circuit diagram 140 may represent an equivalent circuit diagram 144 associated with the ground surface 106-2, the coaxial connector 104-2, and the ground electrode 102. The center portion of the equivalent diagram 140 may represent an equivalent circuit diagram 146 associated with the microstrip feed line 116 and the series-capacitor gap 119.

In certain embodiments, a CRLH transmission structure may be constructed by cascading multiple CRLH magneto-electric unit-cells including the coaxial connectors similar to the coaxial connector 104-1 and/or 104-2 and ground surfaces similar to the ground surfaces 106-1 and/or 106-2 may be placed at a distance less than $\lambda/2$ from each other. Further, in between the ground surfaces the non-resonant meta-surface top patches similar to the non-resonant meta-surface top patches 118-1 and 118-2 may be placed.

The coaxial connectors associated with the multiple CRLH magneto-electric unit-cells may also include the PTFE filled coaxial lines with the central conductor to which the microstrip feed line may be connected to the central conductor. Such microstrip feed line may traverse through the series-capacitor gap from right to left or right to left (depending on the configuration) between the adjacent ground surfaces. The above mentioned arrangements may be similar to as discussed in context of the CRLH magneto-electric unit-cell based structure 100.

Figure 5:
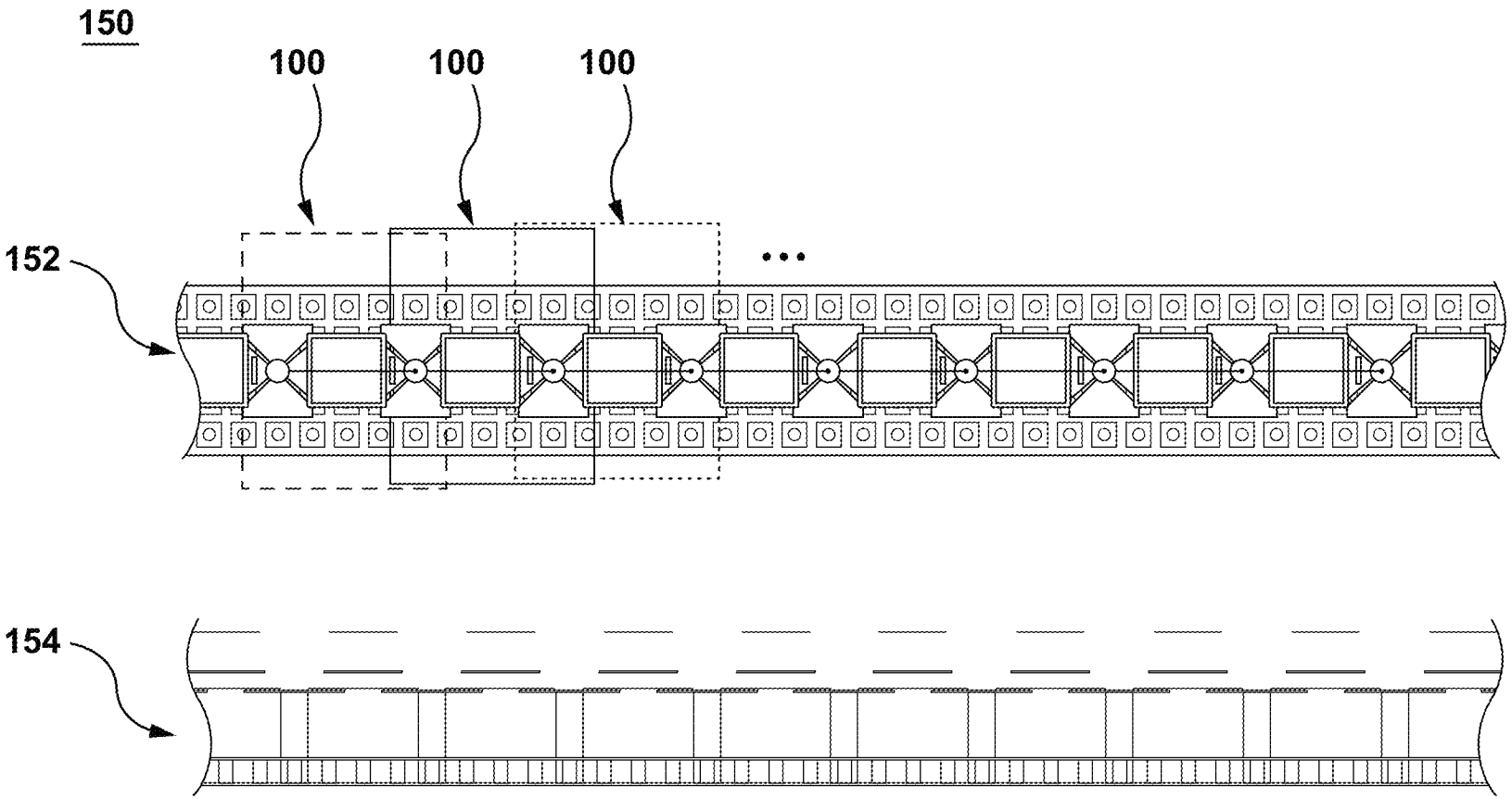
FIG. 5 depicts a top view and a side view of an example of high-level structural diagram of CRLH transmission structure constructed by cascading multiple CRLH magneto-electric unit-cell based structures, in accordance with various embodiments of the present disclosure.

FIG. 5 depicts a top view 152 and a side view 154 of an example of high-level structural diagram of CRLH transmission structure 150 constructed by cascading multiple CRLH magneto-electric unit-cell structures 100, in accordance with various embodiments of the present disclosure.

In certain embodiments, the CRLH transmission structure 150 may include series capacitors and shunt inductors. The series capacitors may be constructed by placing the multiple ground surfaces (such as ground surfaces 106-1 and 106-2) in close proximity along the long axis of the CRLH transmission structure 150. The shunt inductors are constructed by connecting the multiple ground surfaces (such as ground surfaces 106-1 and 106-2) to the ground electrode 102 via multiple coaxial connectors (such as coaxial connectors 104-1, and 104-2).

Further, in certain embodiments, magneto-electric radiating sources may be formed at the series-capacitor gaps (such as the series-capacitor gap 119) between the multiple ground surfaces with the microstrip feed lines (such as microstrip feed line 116) traversing the series-capacitor gaps. In certain embodiments, the microstrip feed lines may be placed at a small distance just above the ground surfaces.

The CRLH transmission structure 150 may include multiple non-resonant meta-surface patches (such as non-resonant meta-surface patches 118-1 and 118-2) placed above the series-capacitor gaps. In certain embodiments, the non-resonant meta-surface top patches may provide impedance matching. In other embodiments, the size of each of the non-resonant meta-surface top patches may be smaller than half-wavelength of their resonant frequency and are not operated in resonant mode. The patches primarily introduce reactive elements for the purpose of impedance matching of excitation sources. In certain embodiments, the microstrip feed lines may be fed with RF signal using the PTFE filled coaxial lines (such as, the PTFE filled coaxial line 110) embedded in the coaxial connectors.

As the RF signal propagates through the microstrip feed lines, the RF signal may induce tangential electric fields across the series-capacitor gaps which may be characterized as an equivalent magnetic current at the series-capacitor gaps which, in turn, may then induce an electric current along the ground surface and the coaxial connector as the wave propagates further down the CRLH transmission structure 150. As a result, both electric and magnetic currents forming an EM field may be excited along the CRLH transmission structure 150.

It is to be noted that the RF signal induces a displacement current in the series-capacitor gaps that results in a magnetic radiating source while the RF signal induces the electric current in the microstrip feed line and the ground surfaces that results in an electric radiating source. Together, the magnetic radiating source and the electric radiating source form a magnetic-electric radiating element.

It is to be noted that the EM field excited in one CRLH magneto-electric unit-cell based structure 100 may spread over to a number of CRLH magneto-electric unit-cell based structures 100 in the CRLH transmission structure 150. The effective distance of the EM field propagation within the CRLH transmission structure 150 may depend on the designed characteristics of each CRLH magneto-electric unit-cell based structures 100. Since the CRLH magneto-electric unit-cell based structures 100 are designed to operate in evanescent modes, couplings between them are relatively low as compared to that of a tightly coupled dipole array. To this end, the CRLH transmission structure 150 may provide a lower return loss due to lower coupling among multiple CRLH magneto-electric unit-cell based structures 100 through evanescent mode propagation of EM field. Consequently, the CRLH transmission structure 150 provides a higher radiating efficiency over a wide scanning angle. Furthermore, the CRLH transmission structure 150 may not require a complex, broadband feed structure and the simple PTFE filled coaxial line 110 may be used to feed the microstrip feed line 116.

In certain embodiments, the CRLH transmission structure 150 may be characterized by the following resonant frequencies:

$$\text{Right-handed corner frequency, } \omega_R = \frac{1}{\sqrt{L_R C_R}}$$

$$\text{Left-handed corner frequency, } \omega_L = \frac{1}{\sqrt{L_L C_L}}$$

-continued $$\text{Shunt resonance frequency, } \omega_{sh} = \frac{1}{\sqrt{L_L C_R}}$$

$$\text{Series resonance frequency, } \omega_{se} = \frac{1}{\sqrt{L_R C_L}}$$

$$\text{Transition frequency, } \omega_o = \sqrt{\omega_R \omega_L}$$

Where, the parameters $C_L$, $C_R$, $L_L$, $L_R$, are the right- and left-hand capacitances and inductances, which are determined by the geometries of the CRLH magneto-electric unit-cell based structure 100. The principal concept of the design is to operate the CRLH magneto-electric unit-cell based structures 100 in the zones where wave propagation in the CRLH transmission structure 150 is in evanescent mode.

Thus, by virtue of the CRLH transmission structure 150, attenuation factors between radiating elements may be controlled such that effective mutual couplings between radiating elements are limited to only a few elements. Also, the CRLH transmission structure 150 allows increase in operating bandwidth of the array through suppressed surface wave and low mutual coupling which results in low directivity loss.

Figure 6:
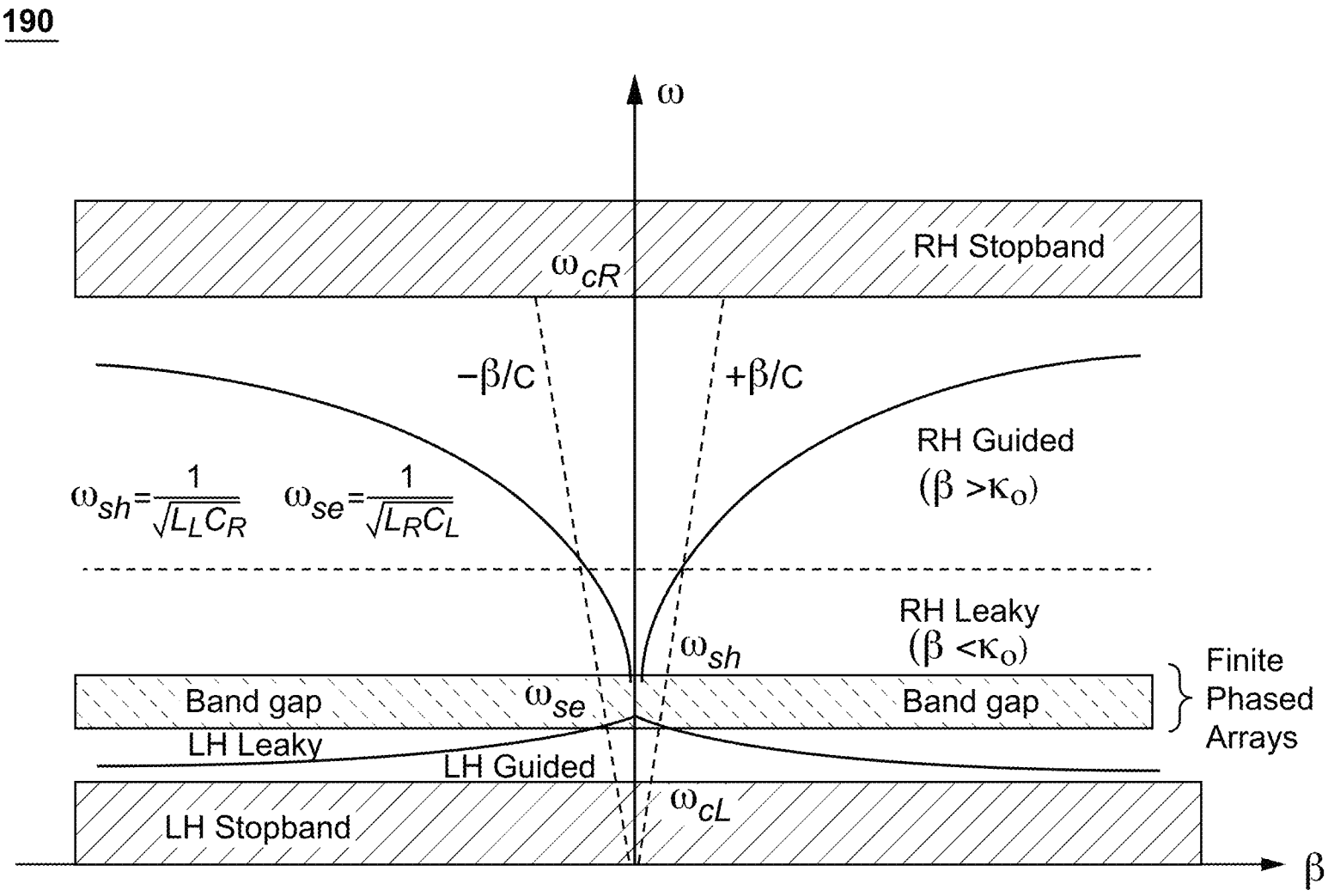
FIG. 6 depicts a general dispersion diagram and bands of the operation of the CRLH transmission structure, in accordance with various embodiments of the present disclosure.

FIG. 6 depicts a general dispersion diagram and bands of the operation of the CRLH transmission structure 150, in accordance with various embodiments of the present disclosure. The CRLH transmission structure 150 may be designed to operate in the frequency band gap between the series resonance frequency ($\omega_{SE}$) and the shunt resonance frequency ($\omega_{SH}$). This gap is due to the difference between series and shunt resonance frequencies ($\omega_{se}$,$\omega_{sh}$). Signal propagations in this region is evanescent in nature, i.e., signals get attenuated significantly but not completely blocked as in the RH and LH stop-band regions.

A conventional CRLH LWA is designed for balanced case ($\omega_{se}=\omega_{sh}$) and aimed to suppress this band-gap. On the contrary, here the band-gap region is exploited for broadband phased array operation using distributed sources. Since the attenuation factor ($\alpha$) of wave propagations is relatively large in this region, mutual couplings between array feeds are minimized and potential reflections from finite array edges are suppressed. A wide band-gap can be achieved by using CRLH magneto-electric unit-cell based structure 100 with a relatively large series inductance ($L_L$) and a small series capacitance ($C_L$), which can be achieved using a planar dipole or monopole in series with a relatively wide series-capacitor gap 119 between the CRLH magneto-electric unit-cell based structure 100. Notice that the series-capacitor gap 119 should be relatively wide in terms of capacitance, but not overly wide to result in isolated radiating elements.

As previously discussed, the CRLH transmission structure 150 may provide ultra broadband characteristics using multiple CRLH magneto-electric unit-cell based structures 100 placed at a spacing of less than half-wavelength along with multi-layer of broadband impedance matching meta-surfaces i.e. the non-resonant meta-surface top patches 118-1 and the non-resonant meta-surface bottom patches 118-2.

Figure 7:
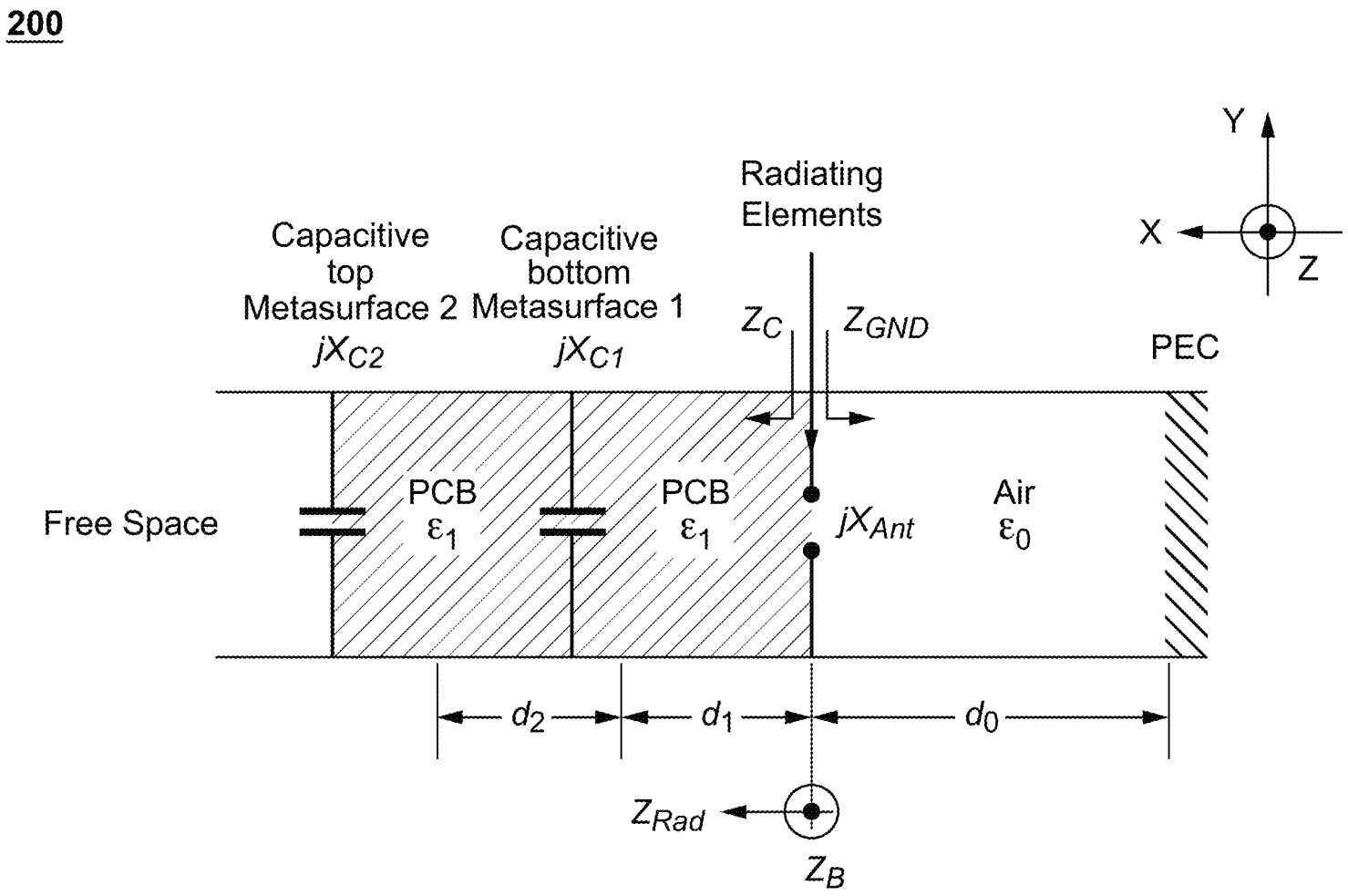
FIG. 7 depicts an equivalent impedance matching circuit diagram of the CRLH transmission structure, in accordance with various embodiments of the present disclosure.

FIG. 7 depicts an equivalent impedance matching circuit diagram 200 of the CRLH transmission structure 150, in accordance with various embodiments of the present disclosure. As shown, the equivalent impedance matching circuit diagram 200 includes an equivalent of radiating elements backed by the equivalent ground electrode 102 on the right side and equivalent of non-resonant meta-surface top patches 118-1 and the non-resonant meta-surface bottom patches 118-2 on the left side printed on the dielectric material. In one embodiment, the dielectric material in between the patches 118-1 and 118-2 and the dielectric material between the bottom patch 118-2 and the radiating elements may have a same dielectric constant and equals to $\varepsilon_1$. In another embodiment, the dielectric material in between the patches 118-1 and 118-2 and the dielectric material between the bottom patch 118-2 and the radiating elements may have different dielectric constants equals to $\varepsilon_1$ and $\varepsilon_2$ respectively.

The total impedance at the plane of the radiating elements may be a sum of the impedance of the radiating elements and parallel of all discontinuity impedances, including the complex element impedance, transformed impedances of the ground electrode 102, and transformed impedances of capacitive meta-surfaces i.e. the patches 118-1 and 118-2. In one embodiment, the total impedance may be represented as:

$$Z_{total}=Z_A+Z_c//Z_{GND}$$

Where, $Z_A$ is the impedance of the radiating elements and may be represented as $Z_A=R_A+jX_A$, $Z_c$ is the transformed impedances of capacitive meta-surface patches 118-1 and 118-2 and may be represented as $Z_c=Z_{c1}(d_1)//(Z_{c2}(d_2))$, and $Z_{GND}$ is the transformed impedances of the ground electrode 102 and may be represented as $Z_{GND}=Z_{PEC}(d_0)$.

It is to be noted that the operational characteristics (e.g. impedances) of the radiating elements and the patches 118-1 and 118-2 tend to cancel out the purely reactive impedance of the ground electrode 102. As a result, the radiating elements provide a relatively wide frequency bandwidth. In certain embodiments, the impedance of the radiating elements may be tuned to a real value over a relatively wide frequency bandwidth by setting the ground electrode 102 and the patches 118-1 and 118-2 at proper locations $d_0$, $d_2$ and $d_1$ respectively. The amplitudes and phases of the complex impedances, $Z_{c1}$ and $Z_{c2}$, associated with the patches 118-2 and 118-1 respectively may be adjusted using geometries of the patches 118-2 and 118-1.

In a non-limiting embodiment of the present disclosure, Table I provides a critical example of dimensions of the example to build or form the CRLH magneto-electric unit-cell based structure 100.

TABLE I

| Parameter | Value |
|---|---|
| Shunt Inductor 104-1 (mm) | 24.2 |
| Shunt Inductor 104-2 (mm) | 3.0 |
| Ground surface 106-1 (mm) | 22.0 |
| Ground surface 106-2 (mm) | 15.0 |
| Thickness of each ground surface 106-1 and 106-2 (mm) | 1.875 |
| Top Patch 118-1 W (mm) | 15 |
| Top Patch 118-1 h (mm) | 39.7 |
| Bottom Patch 118-2 W (mm) | 17 |
| Bottom Patch 118-2 h (mm) | 29.2 |
| Period of unit cell in the CRLH magneto-electric unit-cell based structure 100 (mm) | 30 |
| Dielectric Constant of dielectric substrate 108 | 2.2 |

Table II provides calculated circuit parameters and resonant frequencies of the corresponding CRLH transmission structure 150. In one non-limiting embodiment, as shown in Table II, the CRLH transmission structure 150 may be designed to be a stopband structure with transition frequency near 2.75 GHz, which has a $2^{nd}$ harmonic frequency at about 5.5 GHz.

TABLE II

| Parameter | Value |
|---|---|
| $L_R$ (nH) | 35.35 |
| $C_R$ (pF) | 1.77 |
| $L_L$ (nH) | 2.10 |
| $C_L$ (pF) | 0.09 |
| $f_{cL}$ (GHz) | 11.9 |
| $f_{cR}$ (GHz) | 0.64 |
| $f_{sh}$ (GHz) | 2.61 |
| $f_0$ (GHz) | 2.75 |
| $f_{se}$ (GHz) | 2.89 |

Figure 8:
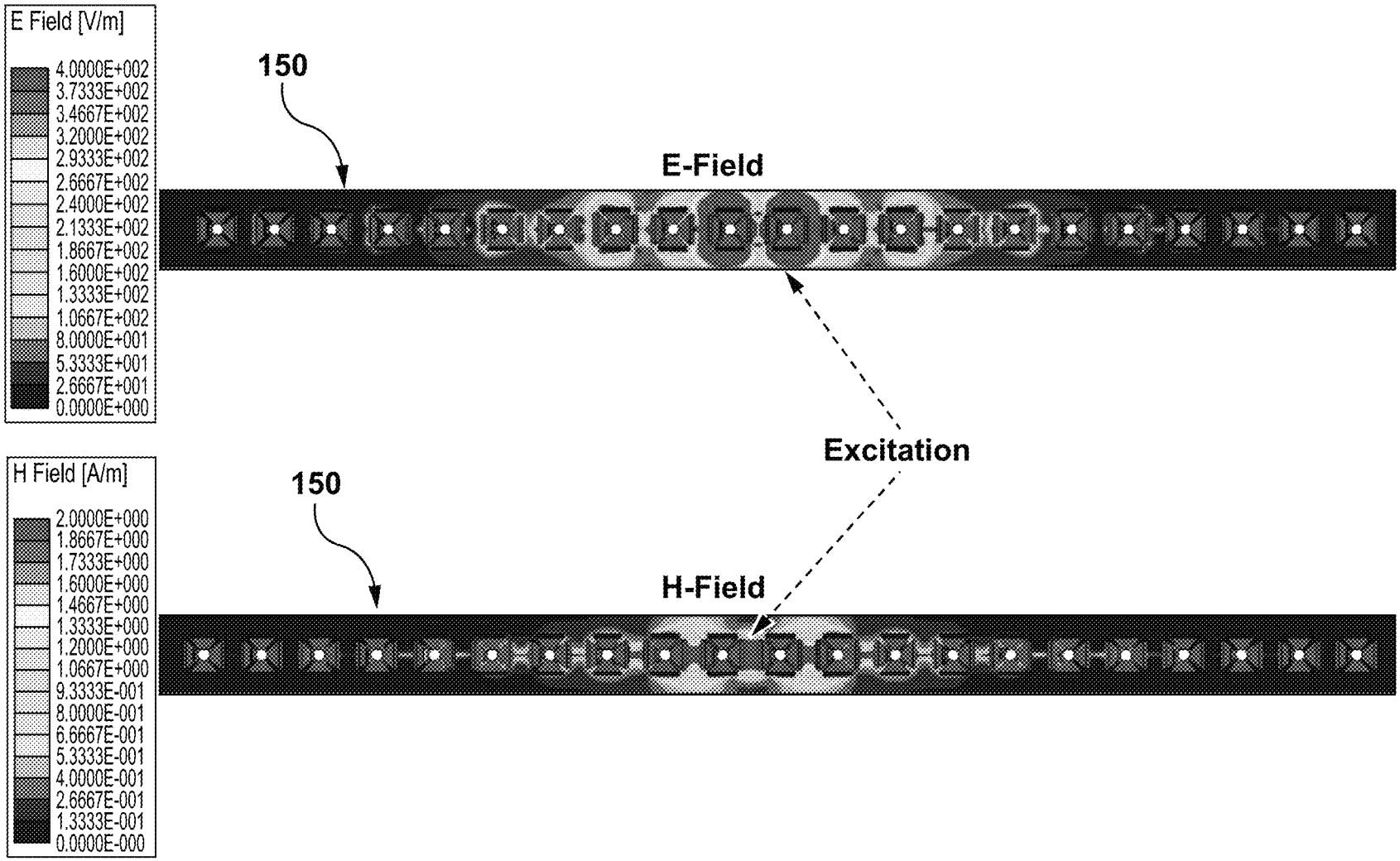
FIG. 8 illustrates the effect of electric and magnetic field excitation of the CRLH magneto-electric unit-cell based structure on other CRLH magneto-electric unit-cell based structures in the CRLH transmission structure, in accordance with various embodiments of present disclosure.

FIG. 8 illustrates the effect of electric and magnetic field excitation of the CRLH magneto-electric unit-cell based structure 100 on other CRLH magneto-electric unit-cell based structures 100 in the CRLH transmission structure 150, in accordance with various embodiments of present disclosure. As shown if the CRLH magneto-electric unit-cell based structure 100 is excited with the electric and magnetic field, in certain embodiments, the mutual coupling effect may be limited to 4-5 adjacent CRLH magneto-electric unit-cell based structures 100.

Figure 9:
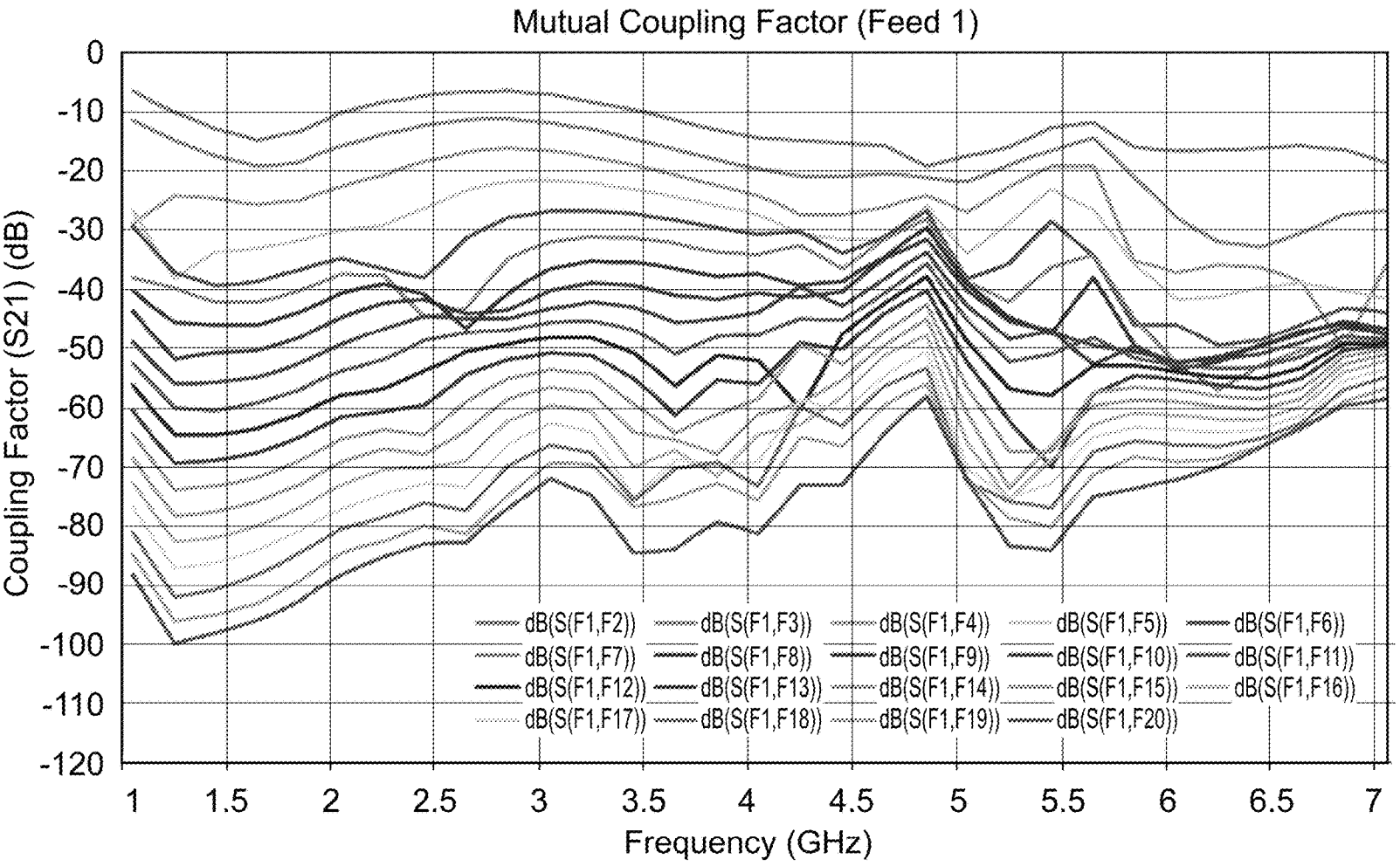
FIG. 9 depicts a representative outcome corresponding to a mutual coupling between a first feed source for frequency between 1 to 7 GHz feeding one CRLH magneto-electric unit-cell based structure and other feed sources for frequency between 1 to 7 GHz feeding other CRLH magneto-electric unit-cell based structures in an array of 20 CRLH magneto-electric unit-cell based structures, in accordance with various embodiments of present disclosure.

FIG. 9 depicts a representative outcome 300 corresponding to a mutual coupling between a first feed source for frequency between 1 GHz to 7 GHz feeding one CRLH magneto-electric unit-cell based structure 100 and other feed sources for frequency between 1 GHz to 7 GHz feeding other CRLH magneto-electric unit-cell based structures 100 in an array of 20 CRLH magneto-electric unit-cell based structures 100, in accordance with various embodiments of present disclosure. As shown, mutual coupling between the radiating elements is dropped below −25 dB after the fifth radiating element away from the active radiating element. In certain embodiments, near the $2^{nd}$ harmonic frequency of 5 GHz to 5.5 GHz, the mutual coupling further reduced significantly as illustrated.

Figure 10:
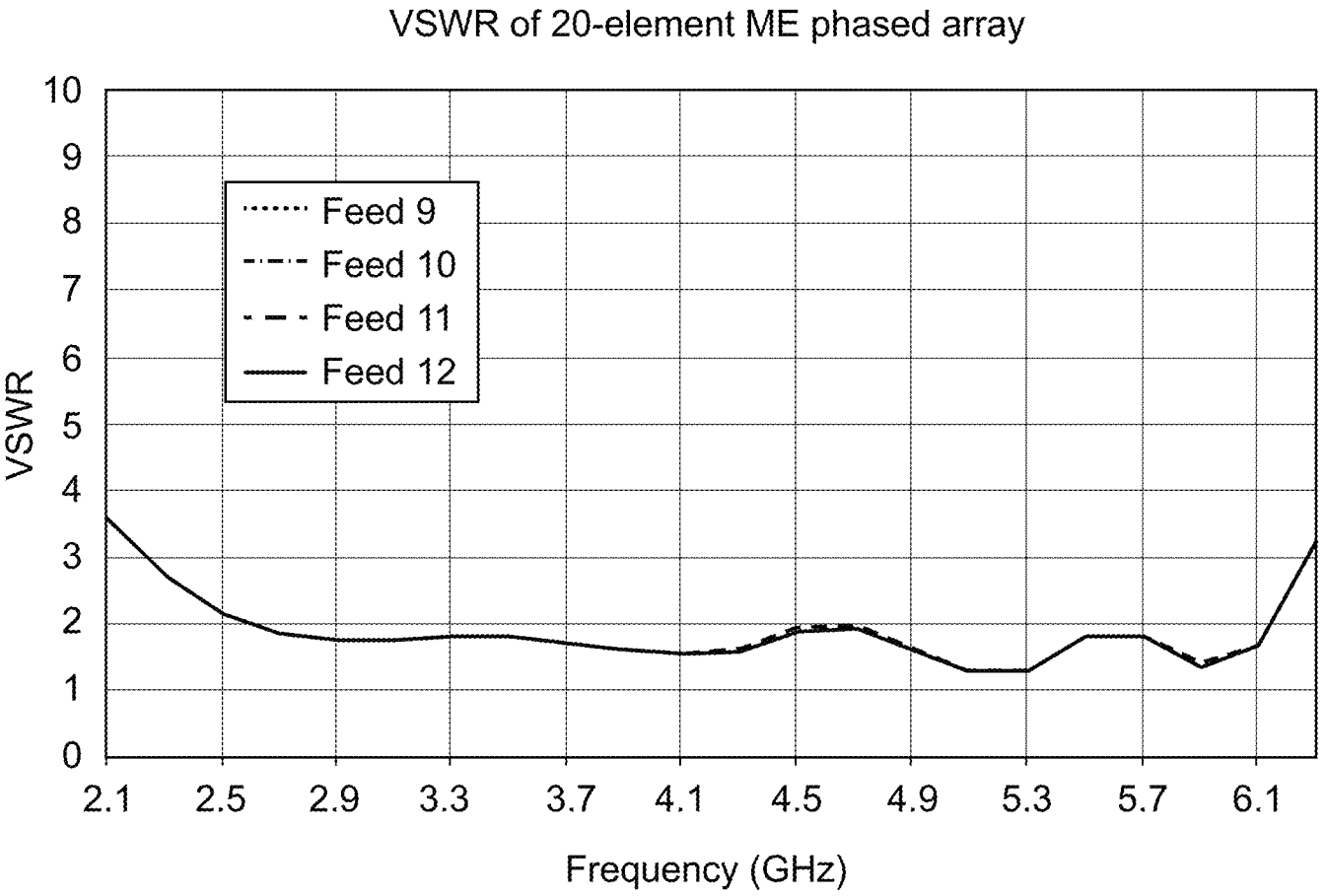
FIG. 10 illustrates a representative outcome corresponding to VSWR (S11) of the CRLH transmission structure including an array of 20 CRLH magneto-electric unit-cell based structures, in accordance with various embodiments of the present disclosure.

FIG. 10 illustrates a representative outcome 400 corresponding to VSWR (S11) of the CRLH transmission structure 150 including an array of 20 CRLH magneto-electric unit-cell based structures 100, in accordance with various embodiments of the present disclosure. As illustrated, the array of 20 CRLH magneto-electric unit-cell based structures 100 may achieve a VSWR<2 for frequency from 2.5 GHz to 6.1 GHz, which has a bandwidth of about 2.5:1, or a fractional bandwidth of 86%.

It is to be noted that in such a configuration with radiating elements in close proximity, the actual return power losses may also depend on the active impedance rather the passive S11 parameter of individual radiating elements. This is because, unlike in a single antenna case, the actual return power losses may be due to the active impedance of the array of radiating elements including mutual coupling. Also, the active impedance of the array of radiating elements may be significantly different from that of isolated elements (S11), depending on radiating element spacing and scan angle of the array of radiating elements.

Figure 11:
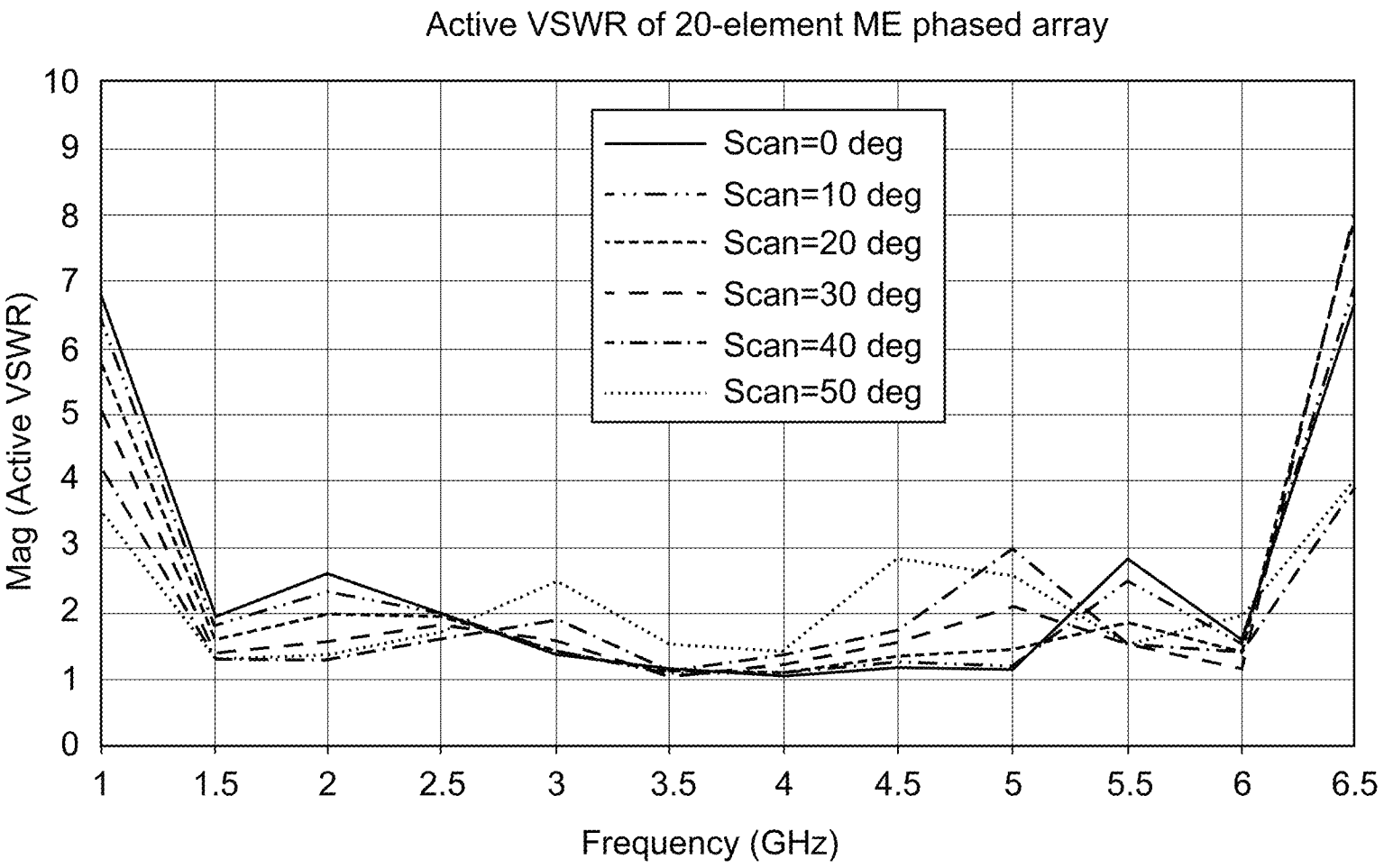
FIG. 11 depicts a representative outcome to Active VSWR of the CRLH transmission structure including an array of 20 CRLH magneto-electric unit-cell based structures for various scan angles for frequency between 1 and 6 GHz, in accordance with various embodiments of the present disclosure.

FIG. 11 depicts a representative outcome 500 to Active VSWR of the CRLH transmission structure 150 including an array of 20 CRLH magneto-electric unit-cell based structures 100 for various scan angles for frequency between 1 and 6 GHz, in accordance with various embodiments of the present disclosure. As depicted, the magnitude of the Active VSWR<3 may be achieved for the frequency range between 1.5 to 6 GHz for scan angles from 0 deg to 50 deg.

Figure 12:
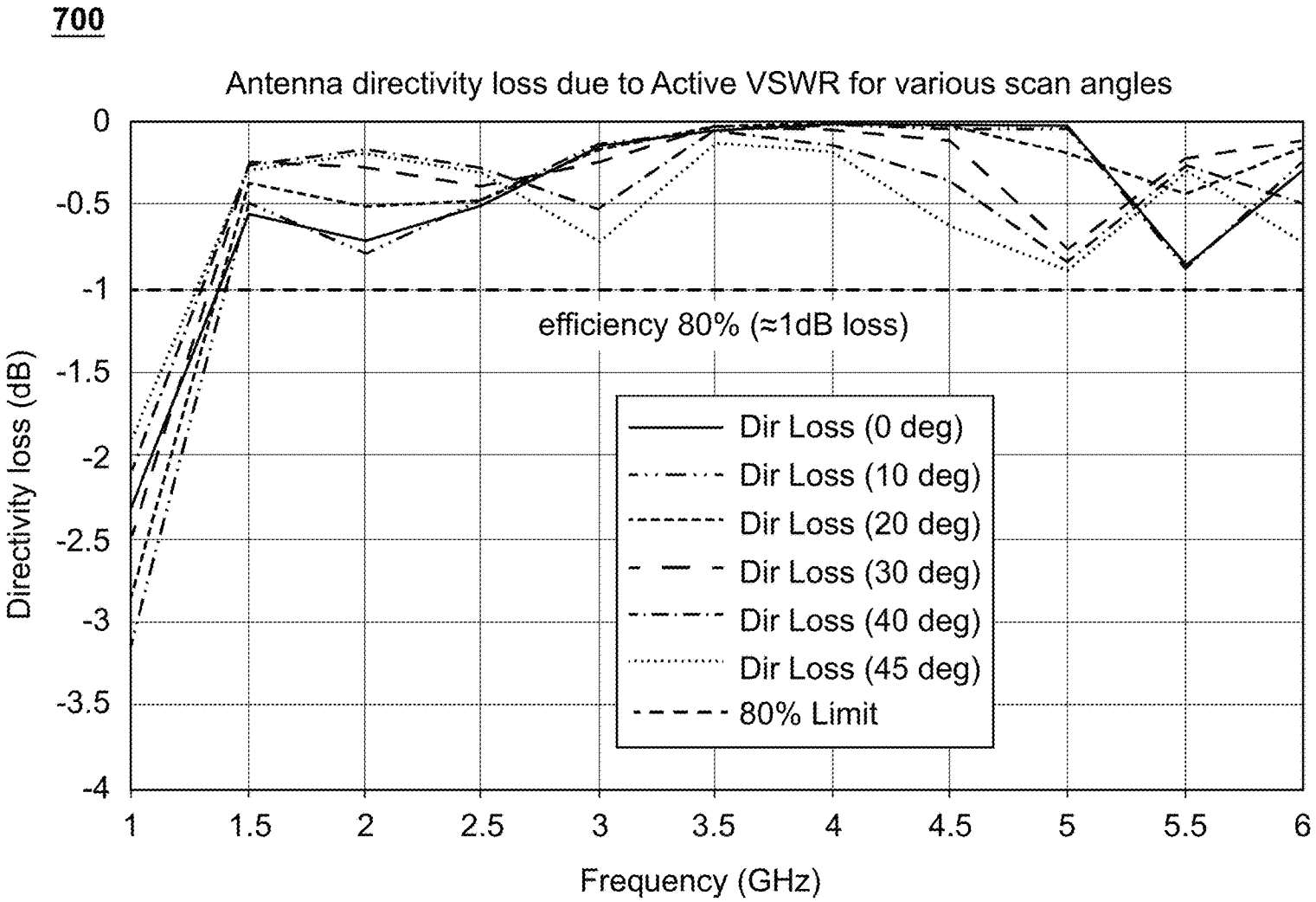
FIG. 12 illustrates a representative outcome corresponding to directivity loss of the CRLH transmission structure due to active VSWR for scan angle between 0 to 45 deg, in accordance with various embodiments of the present disclosure.

FIG. 12 illustrates a representative outcome 700 corresponding to directivity loss of the CRLH transmission structure 150 due to active VSWR for scan angle between 0 deg to 45 deg, in accordance with various embodiments of the present disclosure. As illustrated, in certain embodiments, the directivity loss of the CRLH transmission structure 150 due to the active VSWR may be within −1 dB (−10 dB active return loss) between 1 GHz to 6 GHz for scan angles up to 50 deg.

Figure 13A:
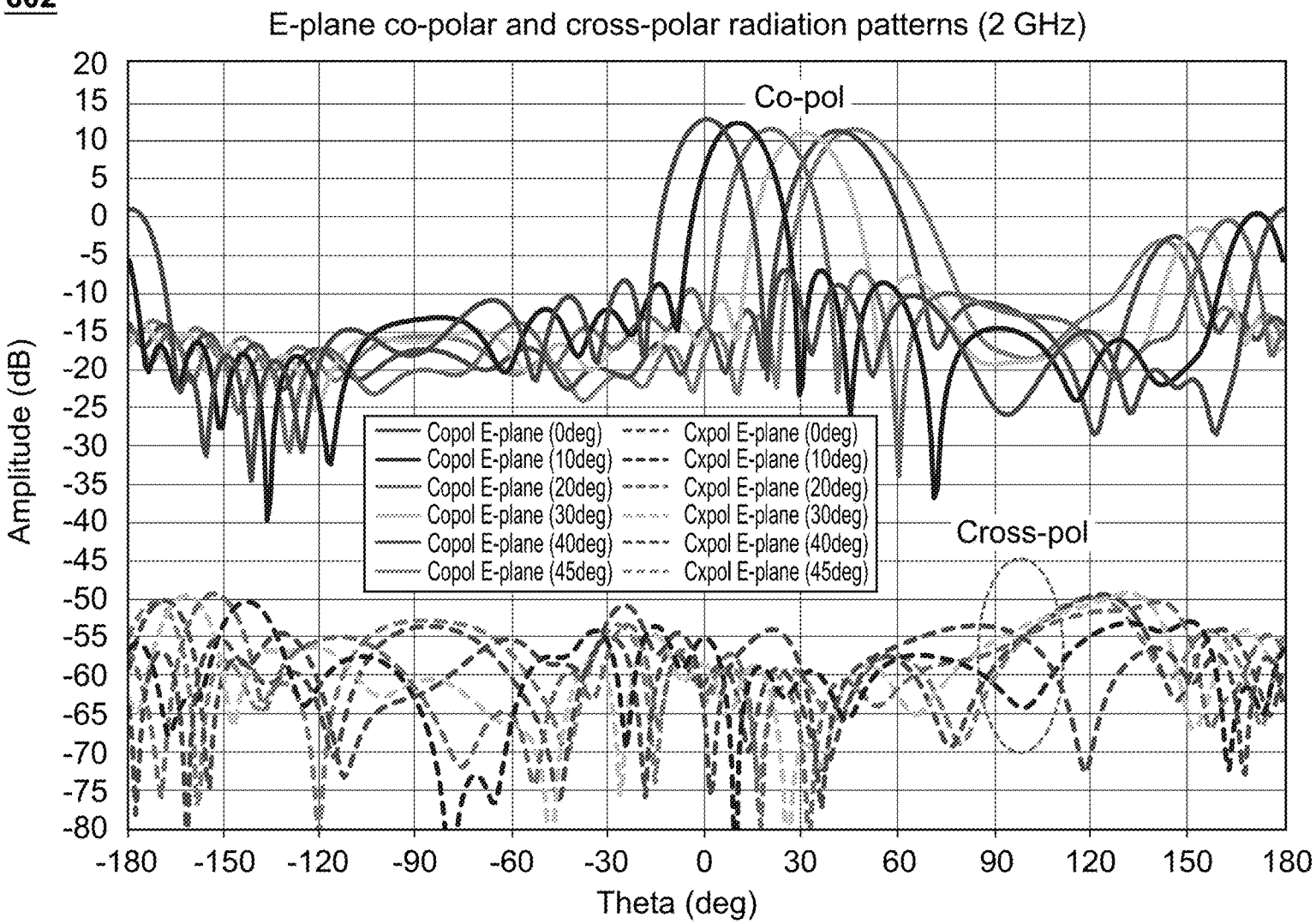
FIGS. 13A-13C depict representative E-plane co-polar and cross-polar radiation patterns of the CRLH transmission structure including an array of 20 CRLH magneto-electric unit-cell based structures for various scan angles, in accordance with various embodiments of the present disclosure.
Figure 13B:
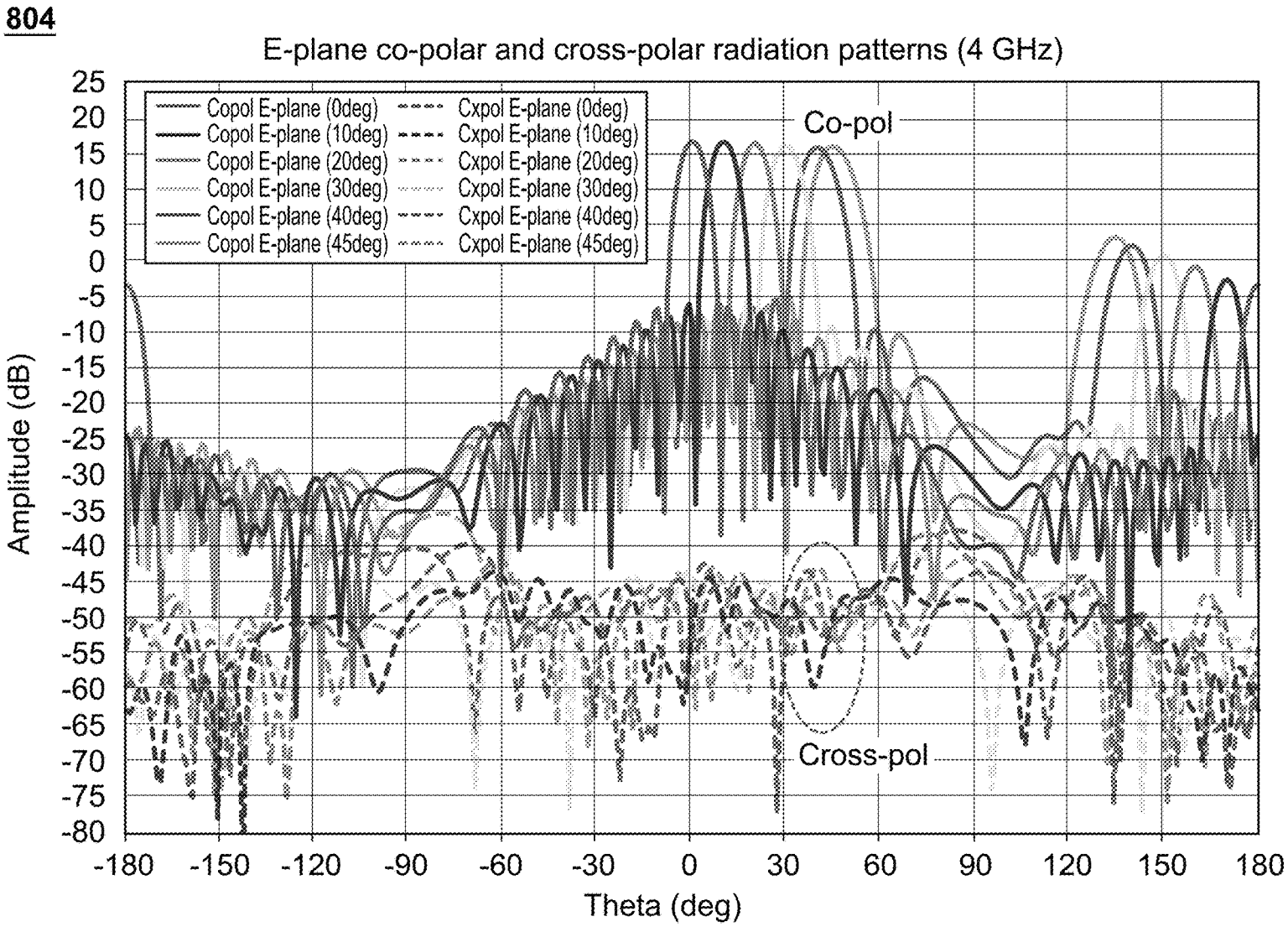
Figure 13C:
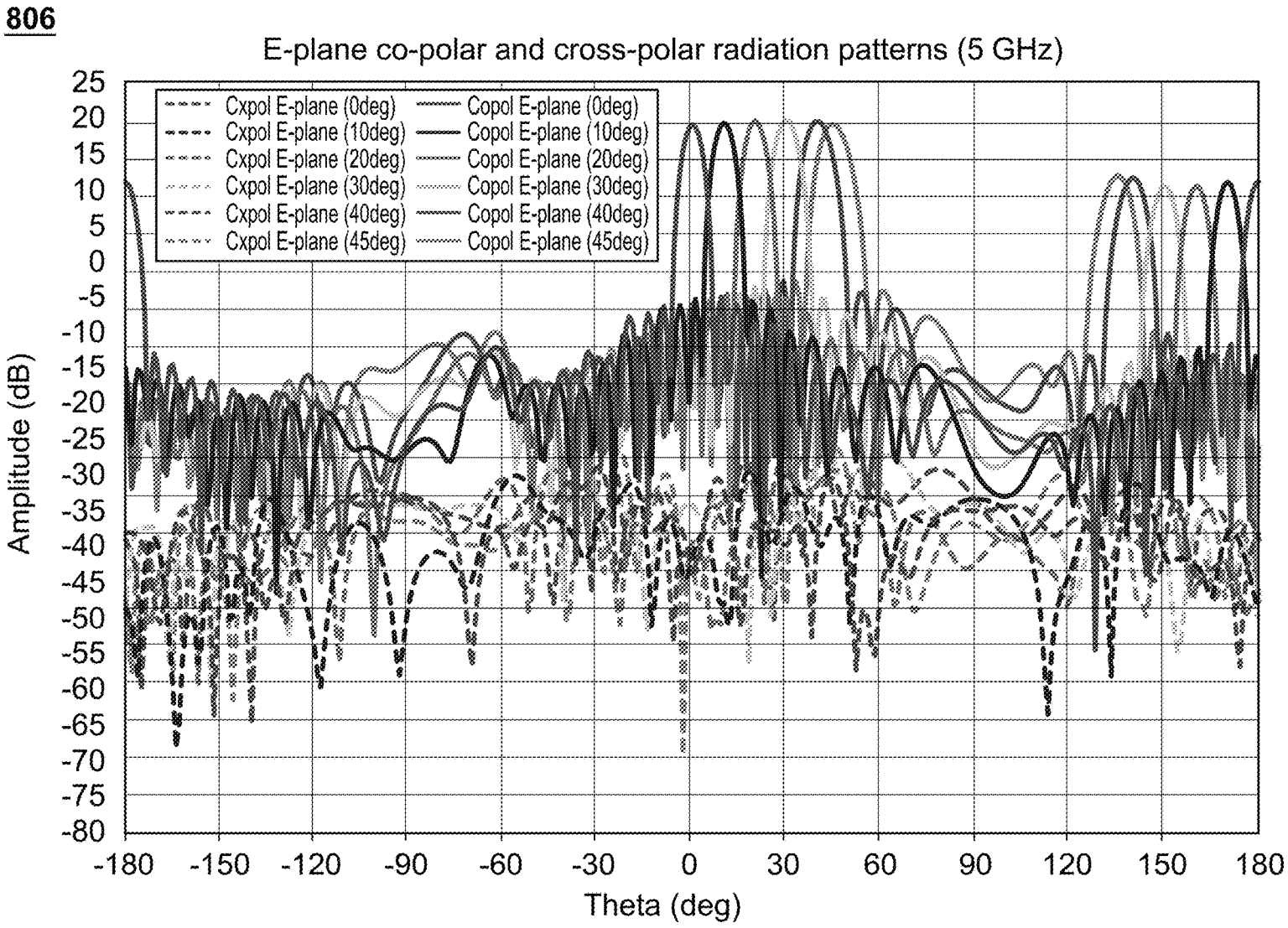

FIGS. 13A-13C depict representative E-plane co-polar and cross-polar radiation patterns of the CRLH transmission structure 150 including an array of 20 CRLH magneto-electric unit-cell based structures 100 for various scan angles, in accordance with various embodiments of the present disclosure. In particular, FIG. 13A depicts E-plane co-polar and cross-polar radiation patterns 802 for various scan angles corresponding to signal having frequency of 2 GHz. FIG. 13B depicts E-plane co-polar and cross-polar radiation patterns 804 for various scan angles corresponding to signal having frequency of 4 GHz. FIG. 13C depicts E-plane co-polar and cross-polar radiation patterns 806 for various scan angles corresponding to signal having frequency of 6 GHz.

Figure 14:
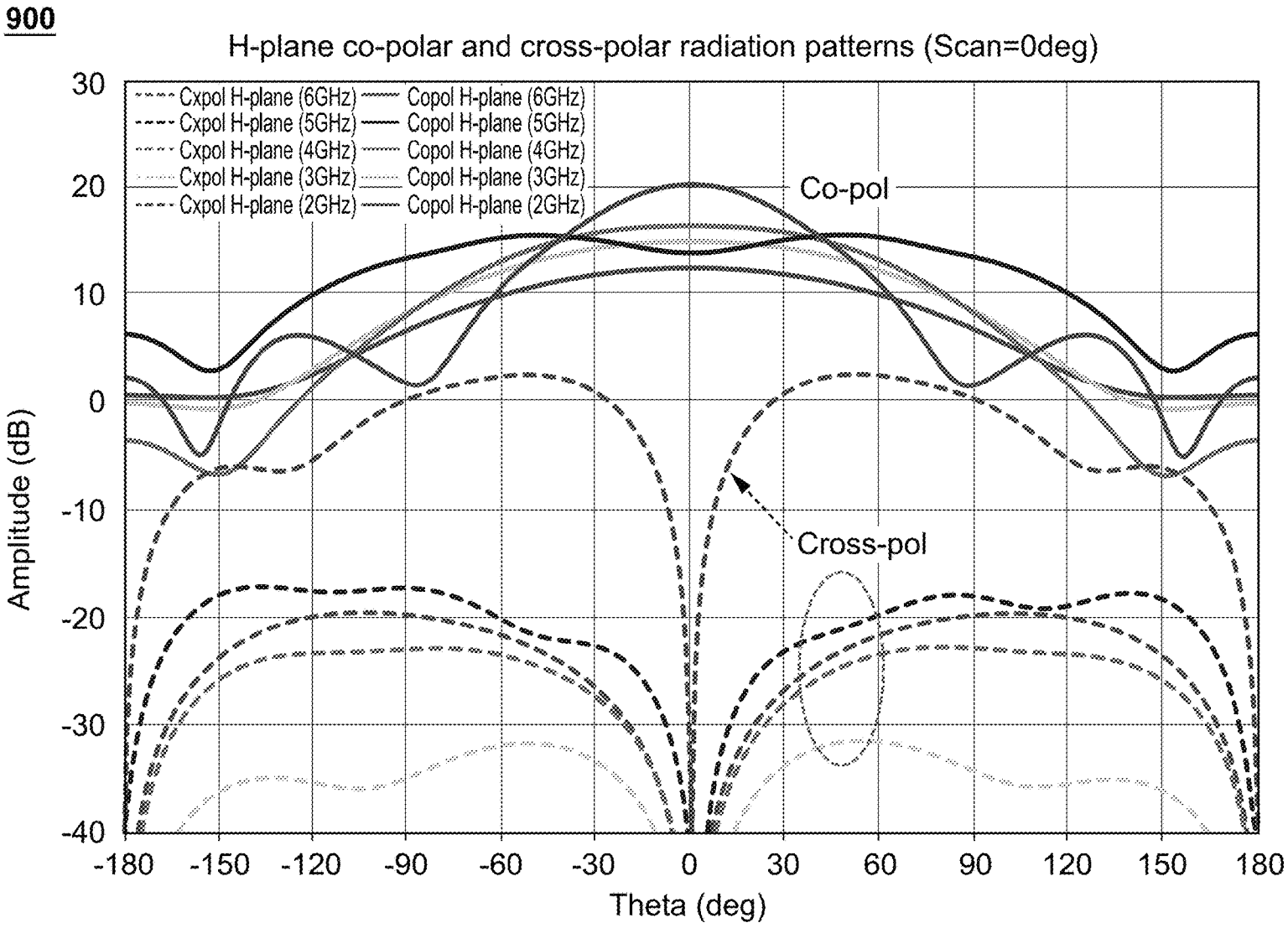
FIG. 14 illustrates representative H-plane co-polar and cross-polar radiation patterns of the CRLH transmission structure including an array of 20 CRLH magneto-electric unit-cell based structures for various frequencies corresponding to scan angle equals to 0 deg, in accordance with various embodiments of the present disclosure.

FIG. 14 illustrates representative H-plane co-polar and cross-polar radiation patterns 900 of the CRLH transmission structure 150 including an array of 20 CRLH magneto-electric unit-cell based structures 100 for various frequencies corresponding to scan angle equals to 0 deg, in accordance with various embodiments of the present disclosure.

An incredibly low cross-polarized field, below −40 dB within the main lobe, for all scan angles has been observed both for E- and H-plane patterns in various embodiments.

Figure 15:
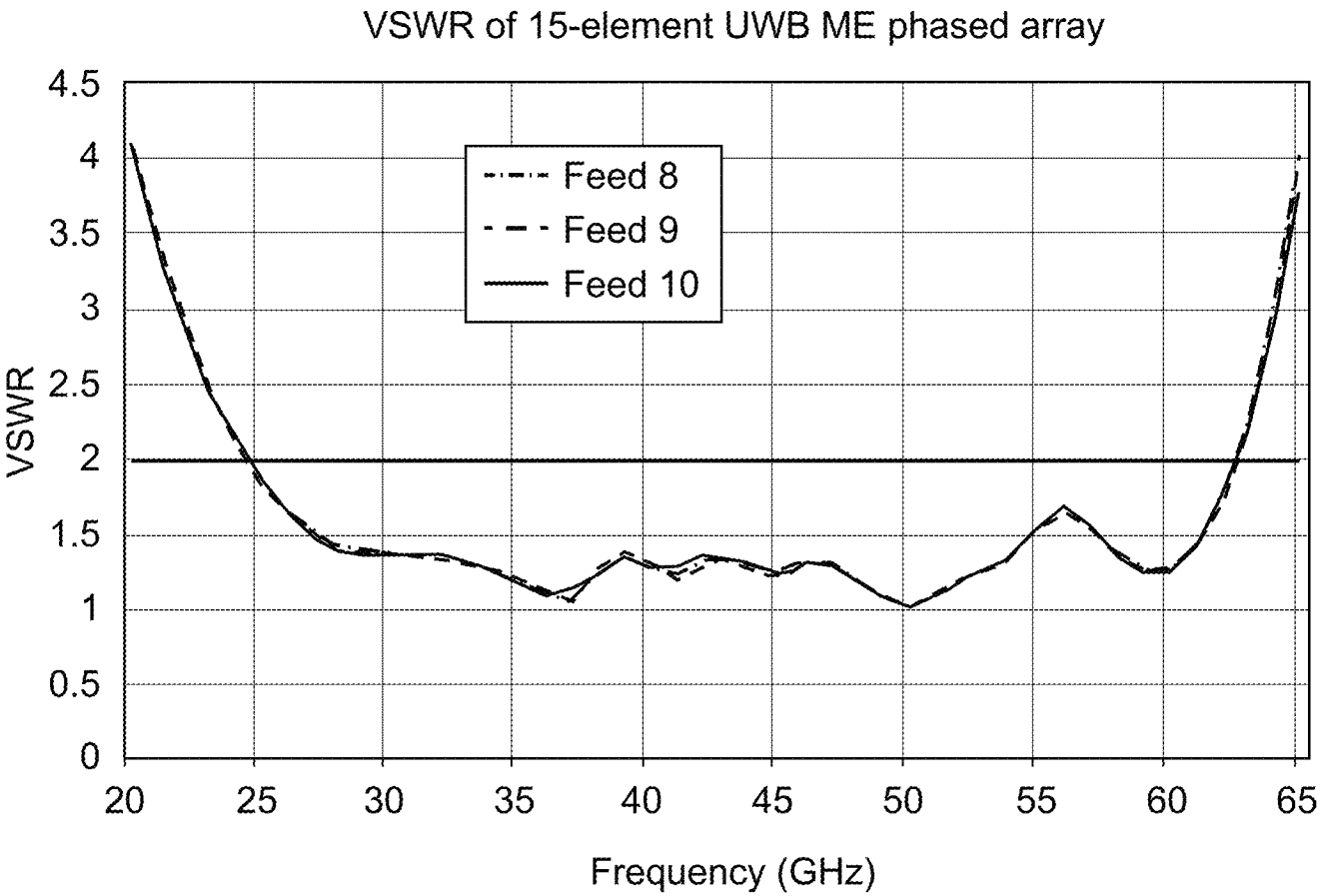
FIG. 15 illustrates a representative passive VSWR versus ultra-high frequency response for the CRLH transmission structure including an array of 15 CRLH magneto-electric unit-cell based structures, in accordance with various embodiments of the present disclosure.

It is to be noted that the broadband characteristics of the CRLH transmission structure 150 is even more evident at higher frequencies. FIG. 15 illustrates a representative passive VSWR versus ultra-wideband (UWB) frequency response 1000 for the CRLH transmission structure 150 including an array of 15 CRLH magneto-electric unit-cell based structures 100, in accordance with various embodiments of the present disclosure. As shown, in certain embodiments, the array of 15 CRLH magneto-electric unit-cell based structures 100 has an impedance bandwidth of 2.5:1 (25 GHz to 62.5 GHz) with VSWR<2, which is 86% of fractional frequency bandwidth.

Figure 16:
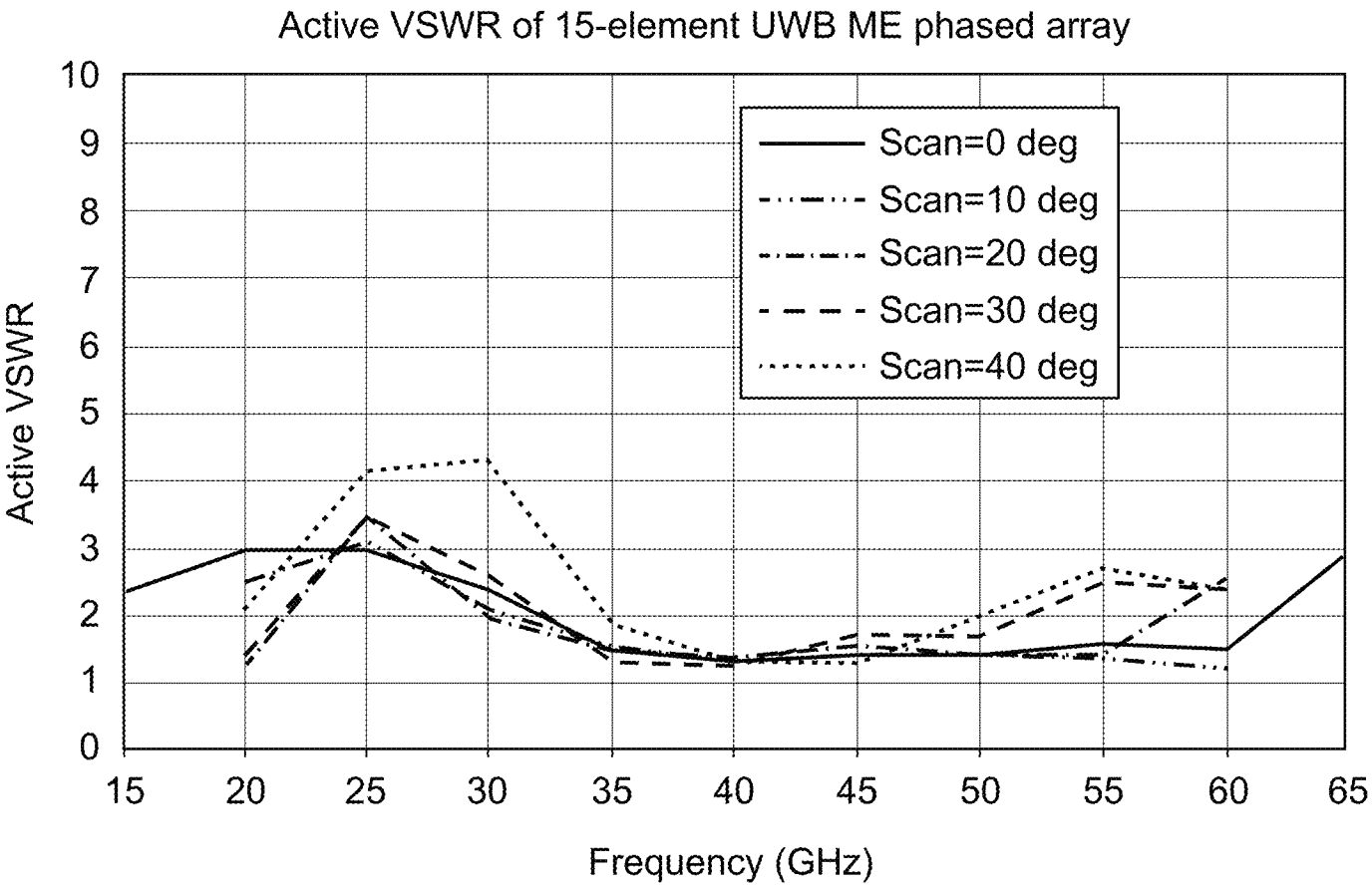
FIG. 16 illustrates a representative active VSWR versus ultra-high frequency response for the CRLH transmission structure including an array of 15 CRLH magneto-electric unit-cell based structures, in accordance with various embodiments of the present disclosure.

FIG. 16 illustrates a representative active VSWR versus UWB frequency response 1100 for the CRLH transmission structure 150 including an array of 15 CRLH magneto-electric unit-cell based structures 100, in accordance with various embodiments of the present disclosure. As shown, in certain embodiments, the array of 15 CRLH magneto-electric unit-cell based structures 100 may achieve a frequency bandwidth of more than 100% (15 GHz to 65 GHz) with active VSWR of <3 for scan angles up to 30 deg. Thus, in certain embodiments, the CRLH transmission structure 150 may be configured to provide a bandwidth up to 65 GHz.

Figure 17A:
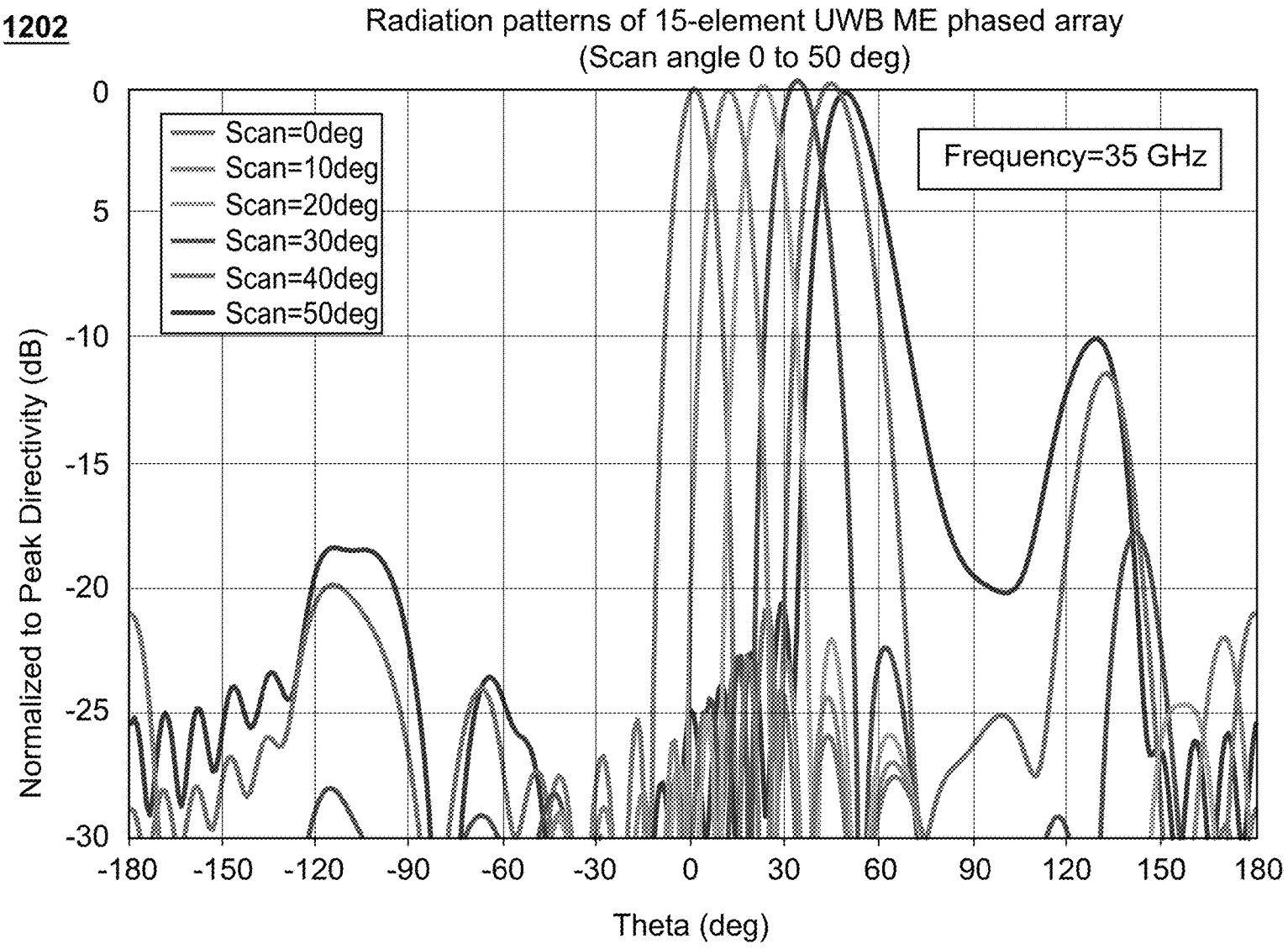
FIGS. 17A-17D depict representative radiation patterns for the CRLH transmission structure including an array of 15 CRLH magneto-electric unit-cell based structures operated at UWB frequency, in accordance with various embodiments of the present disclosure.
Figure 17B:
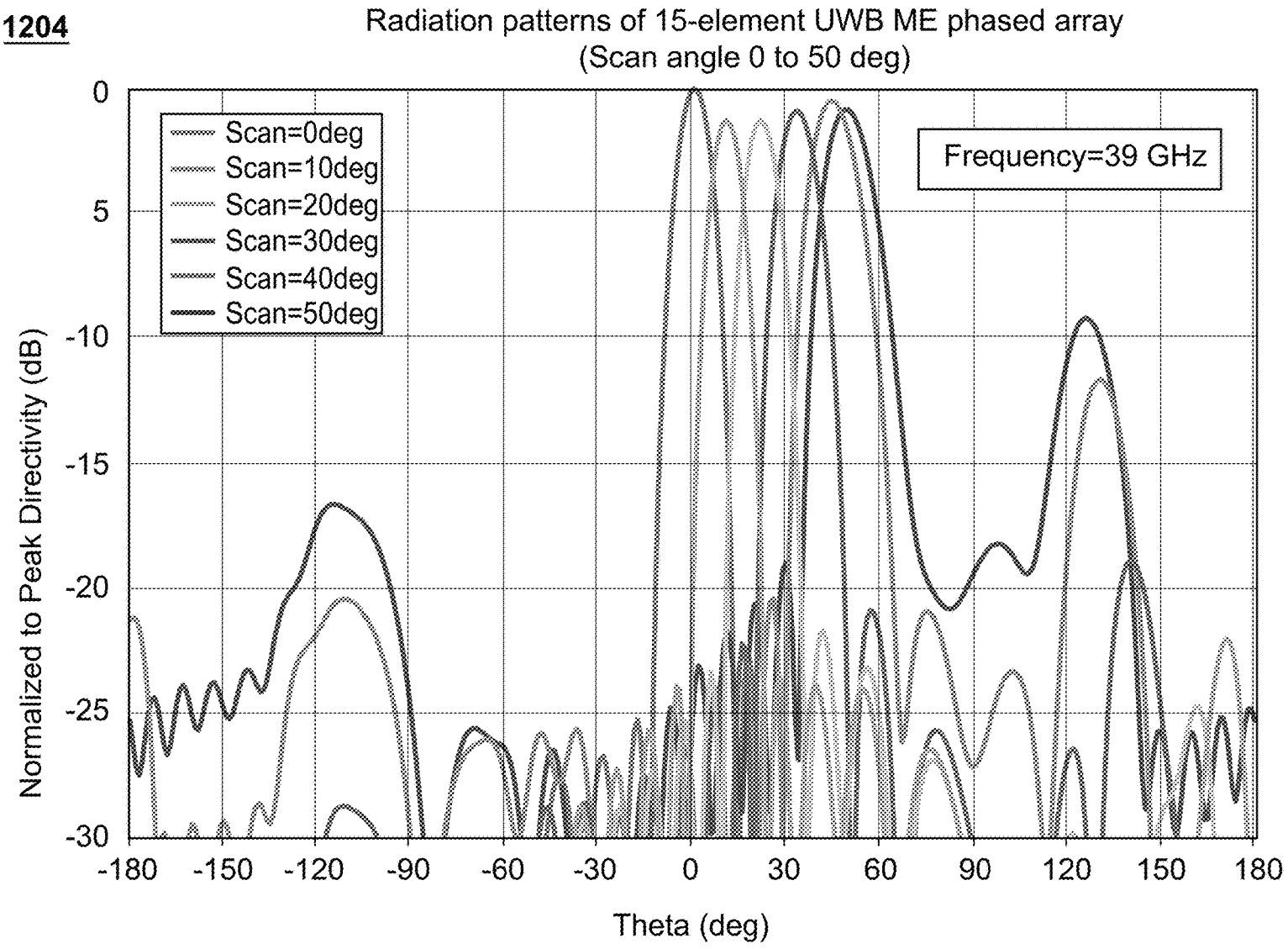
Figure 17C:
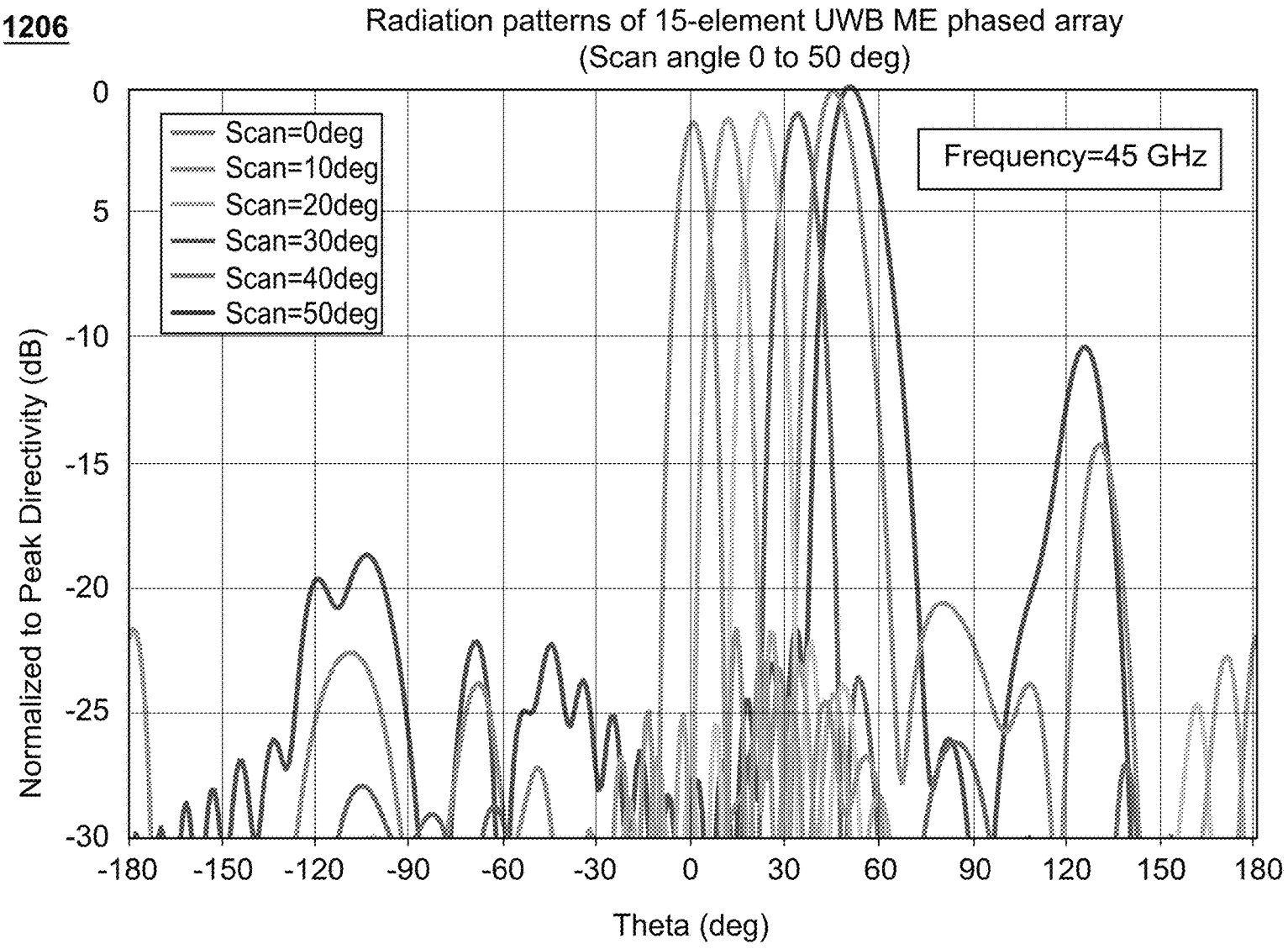
Figure 17D:
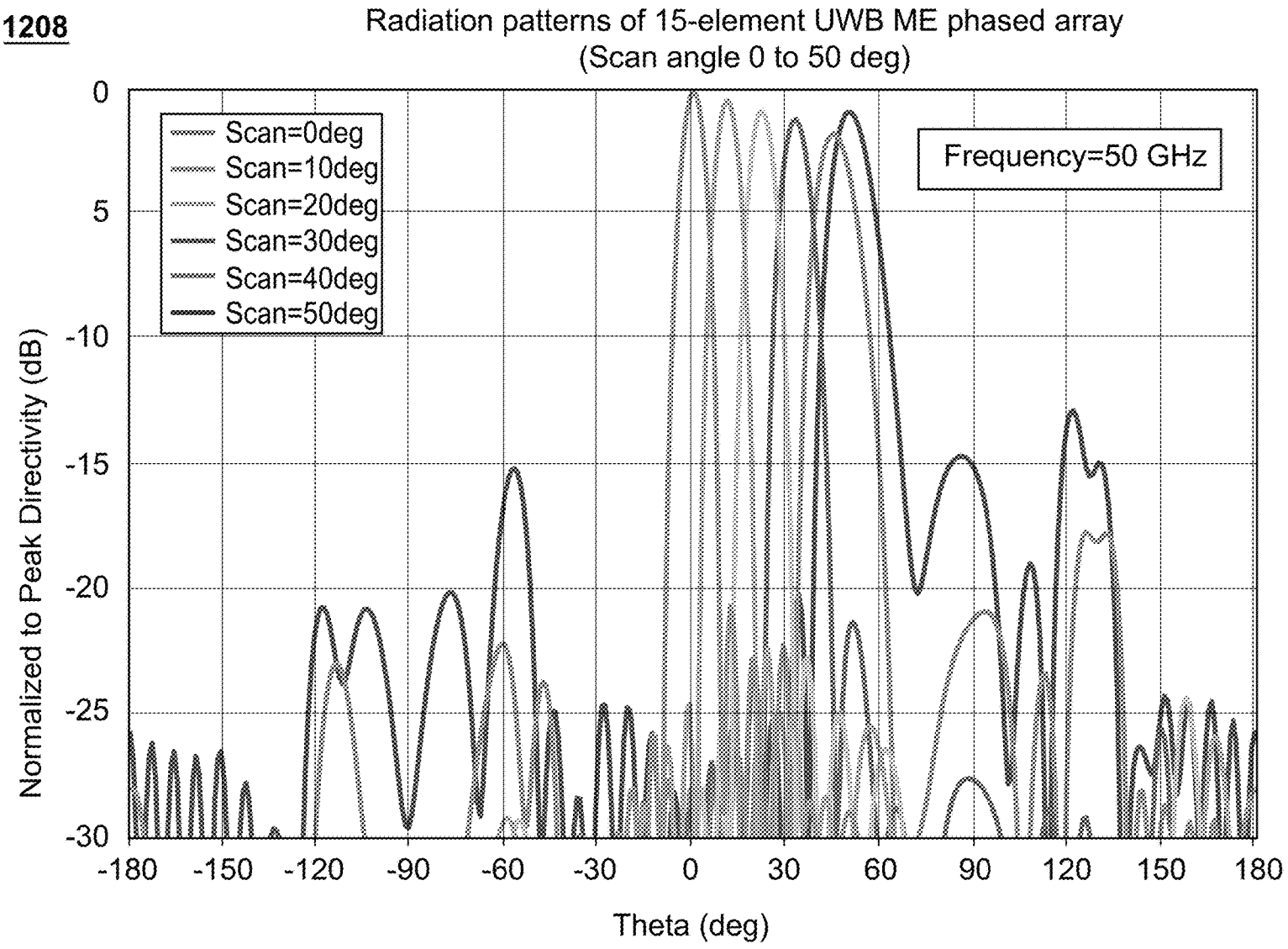

FIGS. 17A-17D depict representative radiation patterns for the CRLH transmission structure 150 including an array of 15 CRLH magneto-electric unit-cell based structures 100 operated at UWB frequency, in accordance with various embodiments of the present disclosure. In particular, FIG. 17A depicts radiation patterns 1202 for various scan angles corresponding to signal having frequency of 35 GHz. FIG. 17B depicts radiation patterns 1204 for various scan angles corresponding to signal having frequency of 39 GHz. FIG. 17C depicts radiation patterns 1206 for various scan angles corresponding to signal having frequency of 45 GHz. FIG. 17D depicts radiation patterns 1208 for various scan angles corresponding to signal having frequency of 50 GHz.

It is to be noted that a conventional phased array including a tightly coupled dipole array has a Cos(θ) of scan loss factor, which gives over 4 dB of scan loss at 45 deg to 50 deg of scan angle. However, in certain embodiments, the scan loss may be less than 1 dB up to 50 deg of scan angles with the CRLH transmission structure 150. To this end, in certain embodiments, the CRLH transmission structure 150 may be configured to provide a scan range of +/−50 deg.

Figure 18:
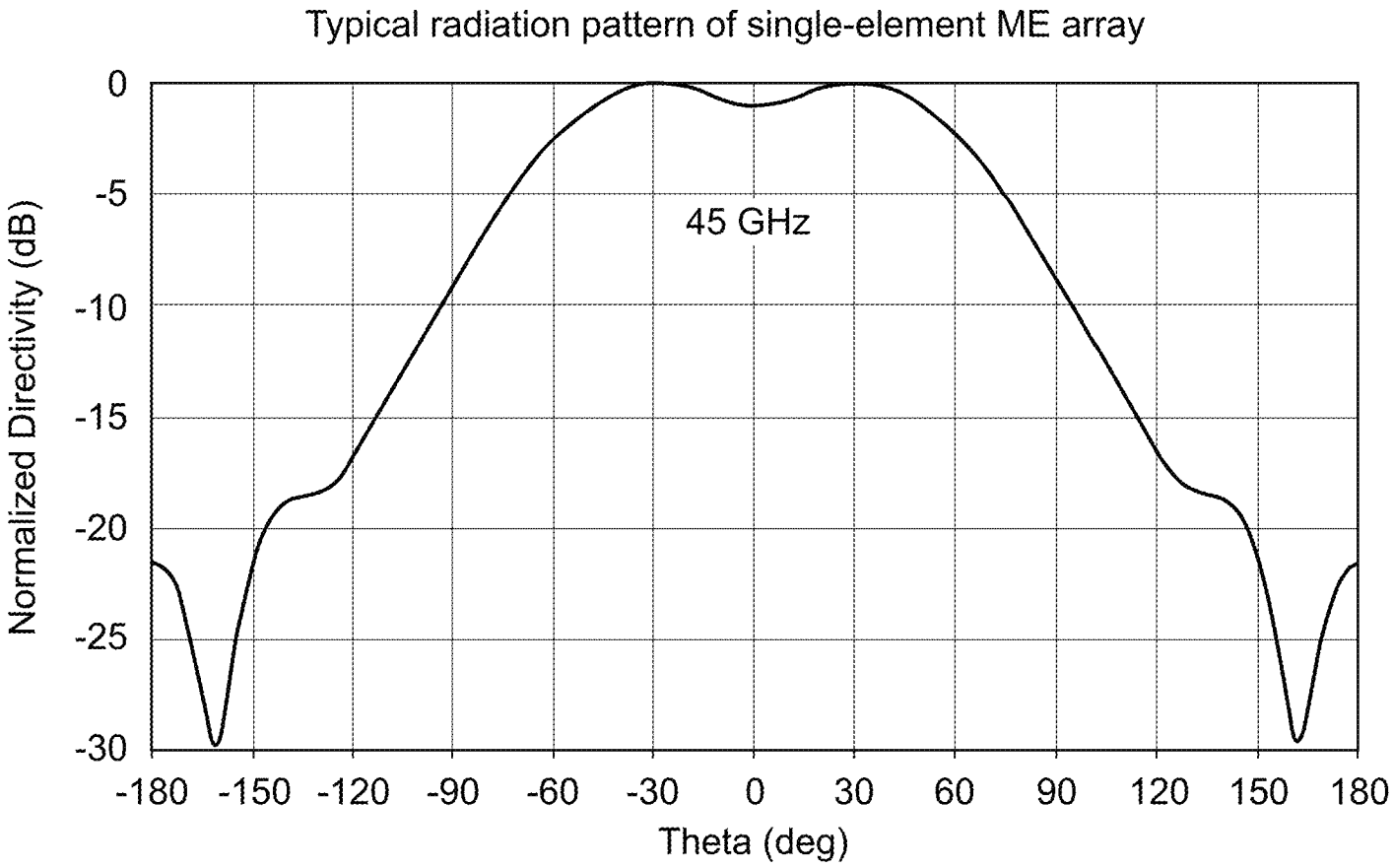
FIG. 18 illustrates a representative outcome corresponding to one CRLH magneto-electric unit-cell based structure in the CRLH transmission structure, in accordance with various embodiments of present disclosure.

FIG. 18 illustrates a representative outcome 1300 corresponding to one CRLH magneto-electric unit-cell based structure 100 in the CRLH transmission structure 150, in accordance with various embodiments of present disclosure. As shown, due to small dimension of the CRLH magneto-electric unit-cell based structure 100, each magneto-electric unit-cell has a relatively broad radiation pattern and, as a result, scan loss may be less than 1 dB up to 50 deg of scan angles.

Figure 19:
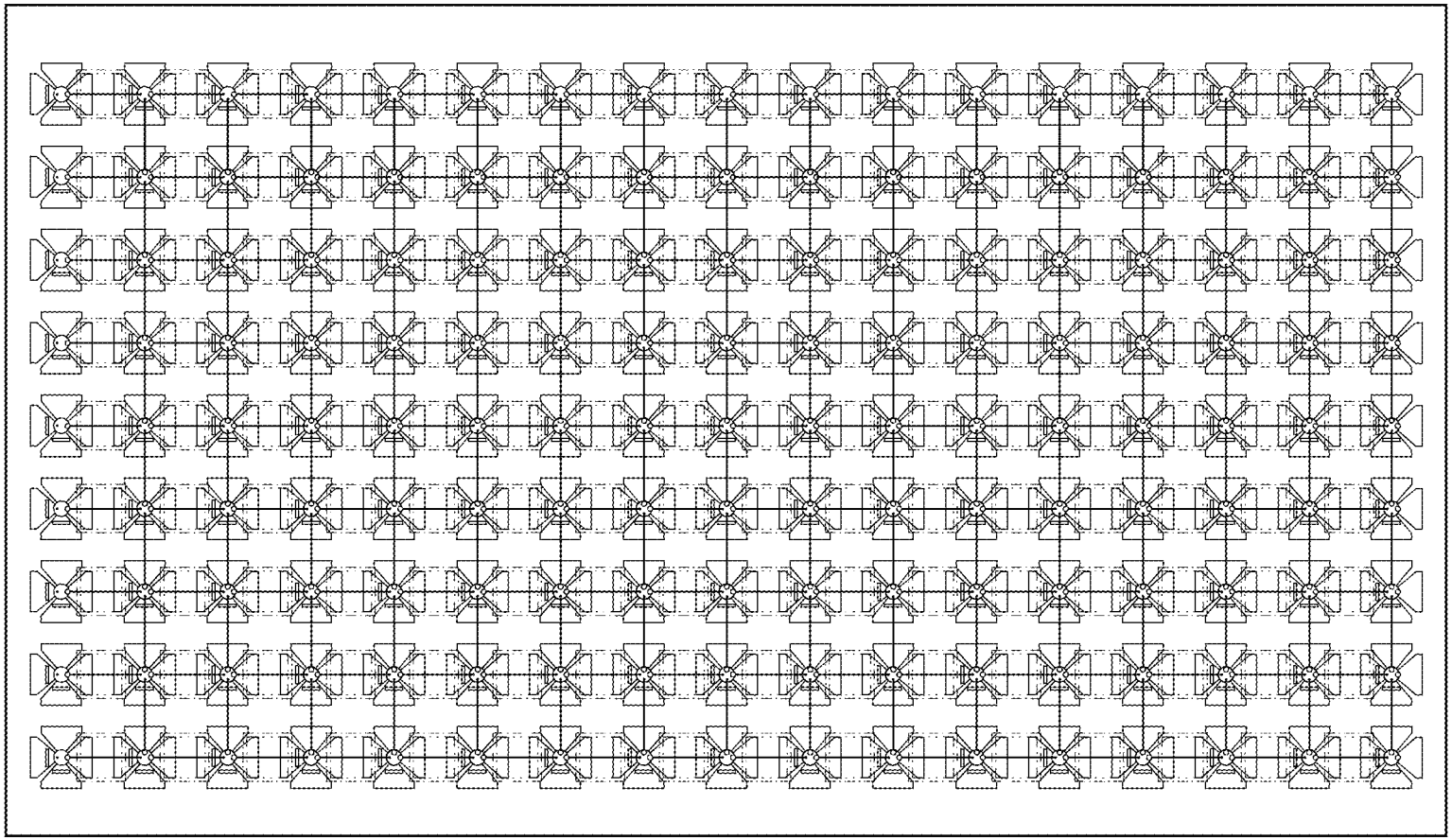
FIG. 19 depicts a top view of an example of high-level 9×16 two-dimensional structural diagram of CRLH transmission structure constructed by cascading multiple CRLH magneto-electric unit-cell based structures, in accordance with various embodiments of the present disclosure.

It to be noted that, in certain embodiments, the CRLH transmission structure 150 may be expanded to two-dimensional dual-polarized phased array structure. FIG. 19 depicts a top view of an example of high-level 9×16 two-dimensional structural diagram of CRLH transmission structure 1400 constructed by cascading multiple CRLH magneto-electric unit-cell based structures 100, in accordance with various embodiments of the present disclosure.

Equally notable, the disclosed structural embodiments of the CRLH transmission structure 150 provides a low-cost antenna structure with a low profile and low-complexity feed that may be operated at ultra-wideband frequency bandwidth and capable of providing flexible beam scanning with relatively wide scanning angle. To this end, the CRLH transmission structure 150 may be implemented in a variety of devices, such as, for example, mobile communication devices, satellite communication devices, wireless routers, base stations, access points, a client terminal in a wireless communication network and other wireless and telecommunication devices and applications. Such devices may be employed in a stationary or mobile environment and may be implemented for communications within 5G communication networks or other wireless communication networks.

Figure 20:
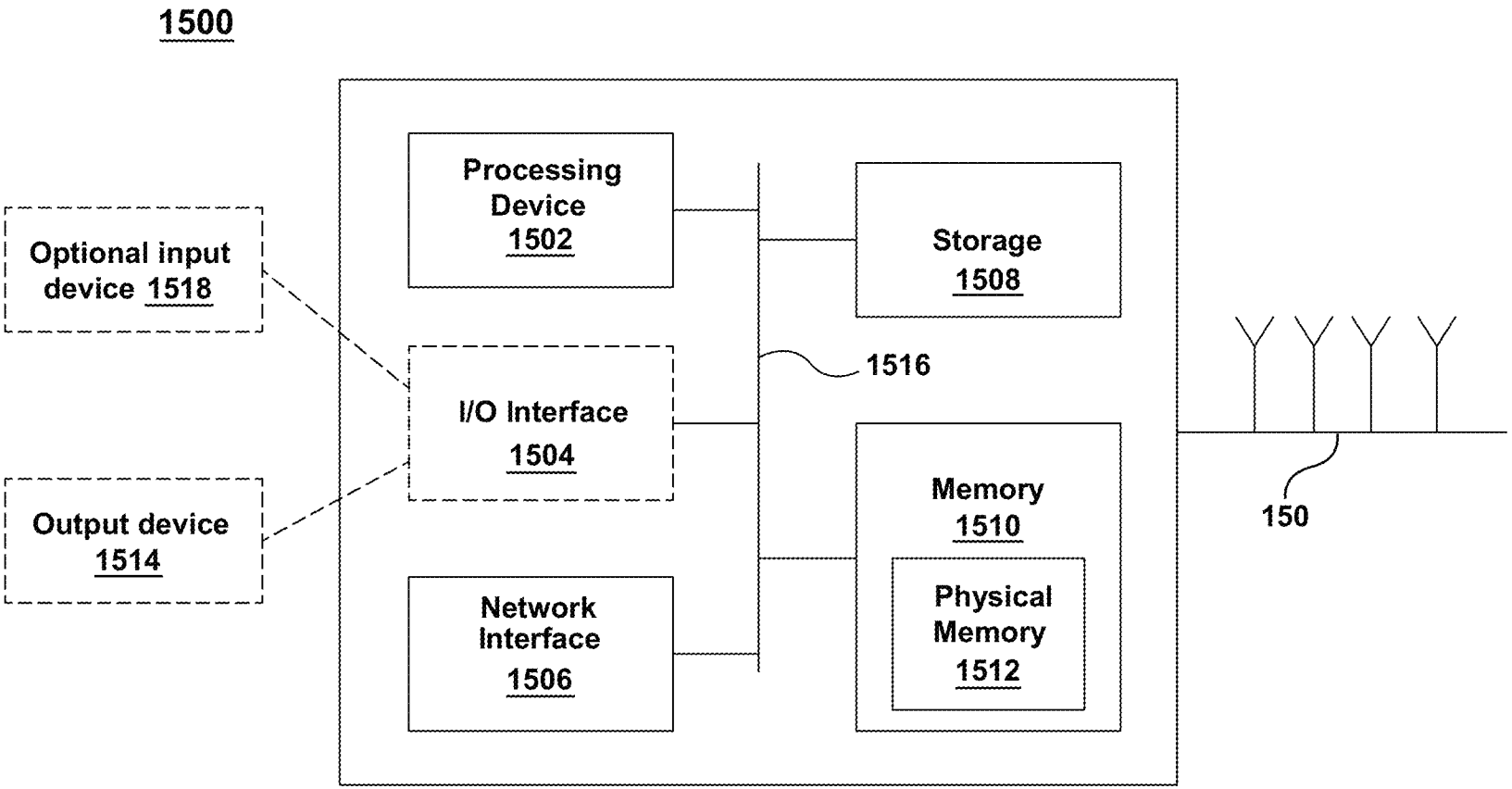
FIG. 20 is a schematic diagram of an example wireless communication device, in which examples of the CRLH transmission structure described herein may be used, in accordance with the embodiments of the present disclosure.

FIG. 20 is a schematic diagram of an example wireless communication device 1500, in which examples of the CRLH transmission structure 150 described herein may be used, in accordance with the embodiments of the present disclosure. For example, the wireless communication device 1500 may be a base station, an access point, or a client terminal in a wireless communication network or the like. The wireless communication device 1500 may be used for communications within 5G communication networks or other wireless communication networks. Although FIG. 20 shows a single instance of each component, there may be multiple instances of each component in the wireless communication device 1500. The wireless communication device 1500 may be implemented using parallel and/or distributed architecture.

The wireless communication device 1500 may include one or more processing devices 1502, such as a processor, a microprocessor, an application-specific integrated circuit (ASIC), a field-programmable gate array (FPGA), a dedicated logic circuitry, or combinations thereof. The wireless communication device 1500 may also include one or more optional input/output (I/O) interfaces 1504, which may enable interfacing with one or more optional input devices 1518 and/or output devices 1514. The wireless communication device 1500 may include one or more network interfaces 1506 for wired or wireless communication with a network (e.g., an intranet, the Internet, a P2P network, a WAN and/or a LAN, and/or a Radio Access Network (RAN)) or other node. The network interface(s) 1506 may include one or more interfaces to wired networks and wireless networks. Wired networks may make use of wired links (e.g., Ethernet cable). The network interface(s) 1506 may provide wireless communication (e.g., full-duplex communications) via an example of the CRLH transmission structure 150. The wireless communication device 1500 may also include one or more storage units 1508, which may include a mass storage unit such as a solid state drive, a hard disk drive, a magnetic disk drive and/or an optical disk drive.

The wireless communication device 1500 may include one or more memories 1510 that can include a physical memory 1512, which may include a volatile or non-volatile memory (e.g., a flash memory, a random access memory (RAM), and/or a read-only memory (ROM)). The non-transitory memory(ies) 1510 (as well as storage 1508) may store instructions for execution by the processing device(s) 1502. The memory(ies) 1510 may include other software instructions, such as for implementing an operating system (OS), and other applications/functions. In some examples, one or more data sets and/or modules may be provided by an external memory (e.g., an external drive in wired or wireless communication with the wireless communication device 1500) or may be provided by a transitory or non-transitory computer-readable medium. Examples of non-transitory computer readable media include a RAM, a ROM, an erasable programmable ROM (EPROM), an electrically erasable programmable ROM (EEPROM), a flash memory, a CD-ROM, or other portable memory storage.

There may be a bus 1516 providing communication among components of the wireless communication device 1500. The bus 1516 may be any suitable bus architecture including, for example, a memory bus, a peripheral bus or a video bus. Optional input device(s) 1518 (e.g., a keyboard, a mouse, a microphone, a touchscreen, and/or a keypad) and optional output device(s) 1514 (e.g., a display, a speaker and/or a printer) are shown as external to the wireless communication device 1500 and connected to optional I/O interface 1504. In other examples, one or more of the input device(s) 1518 and/or the output device(s) 1514 may be included as a component of the wireless communication device 1500.

The processing device(s) 1502 may be used to control communicate transmission/reception signals to/from the CRLH transmission structure 150. The processing device(s) 1502 may be used to control beam steering by the CRLH transmission structure 150, for example by controlling the voltage applied to the isolated ground of the unit cells, for tuning the encapsulated liquid crystal. The processing device(s) 1502 may also be used to control the phase of the phase variable lens, in order to steer the antenna beam over a 2D plane.

It is to be understood that the operations and functionality of the CRLH transmission structure 150, constituent components, and associated processes may be achieved by any one or more of hardware-based, software-based, and firmware-based elements. Such operational alternatives do not, in any way, limit the scope of the present disclosure.

It will also be understood that, although the embodiments presented herein have been described with reference to specific features and structures, it is clear that various modifications and combinations may be made without departing from such disclosures. The specification and drawings are, accordingly, to be regarded simply as an illustration of the discussed implementations or embodiments and their principles as defined by the appended claims, and are contemplated to cover any and all modifications, variations, combinations or equivalents that fall within the scope of the present disclosure.

What is claimed is:

1. An antenna comprising:

a plurality of Composite Right Left Handed (CRLH) magneto-electric unit-cell based structures, each CRLH magneto-electric unit-cell based structure comprising:

a ground electrode for common electrical contacts;

a first coaxial connector and a second coaxial connector, a first end of the first coaxial connector and a first end of the second coaxial connector connected to the ground electrode;

a first ground surface and a second ground surface, the first ground surface connected to a second end of the first coaxial connector and the second ground surface connected to a second end of the second coaxial connector;

a coaxial line included in the second coaxial connector;

a microstrip feed line connected to the coaxial line and electromagnetically coupled with the first and the second ground surfaces; and a first non-resonant meta-surface patch and a second non-resonant meta-surface patch, each of the first and second non-resonant meta-surface patches printed on a dielectric material and placed above a series-capacitor gap between the first ground surface and the second ground surface and electromagnetically coupled to the first ground surface and the second ground surface.

2. The antenna of claim 1, wherein the first coaxial connector includes a second coaxial line.

3. The antenna of claim 1, wherein a radio frequency signal traversing in the microstrip feed line induces a tangential electric field in the series-capacitor gap resulting in a magnetic radiating source;

the radio frequency signal induces an electric current in the microstrip feed line and the first ground surface resulting in an electric radiating source; and the magnetic radiating source and the electric radiating source form a magnetic-electric radiating element.

4. The antenna of claim 1, wherein the plurality of CRLH magneto-electric unit-cell based structures are separated from each other by a distance less than $\lambda/2$, where $\lambda$ is a wavelength of a radio frequency signal fed to the microstrip feed line via the coaxial line.

5. The antenna of claim 1, wherein a width of the first non-resonant meta-surface patch and the second non-resonant meta-surface patch is less than $\lambda/2$, where $\lambda$ is a wavelength of a radio frequency signal fed to the microstrip feed line via the coaxial line.

6. The antenna of claim 1, wherein the first coaxial connector and the second coaxial connector are separated from each other by a distance less than $\lambda/2$, where $\lambda$ is a wavelength of a radio frequency signal fed to the microstrip feed line via the coaxial line.

7. The antenna of claim 1, wherein the first ground surface and the second ground surface have a tuning slot for RF tuning.

8. The antenna of claim 1, wherein the ground electrode is a ground perfect electric conductor.

9. The antenna of claim 1, wherein the plurality of CRLH magneto-electric unit-cell based structures are arranged as a one-dimensional phased array structure.

10. The antenna of claim 1, wherein the plurality of CRLH magneto-electric unit-cell based structures are arranged as a two-dimensional phased array structure.

11. The antenna of claim 1, wherein the first ground surface and second ground surface are arranged as a bow-tie capacitive structure.

12. The antenna of claim 1, wherein the first coaxial connector and the second coaxial connector are arranged as a shunt inductor structure.

13. The antenna of claim 1, wherein the plurality of CRLH magneto-electric unit-cell based structures are operated in evanescent mode.

14. The antenna of claim 1, wherein the first non-resonant meta-surface patch and the second non-resonant meta-surface patch provide impedance matching.

15. The antenna of claim 1, configured to provide a scan range of +/−50 deg.

16. The antenna of claim 1, configured to provide a bandwidth up to 65 GHz.

17. A wireless communication device comprising:

an antenna structure for receiving and transmitting wireless signals, the antenna structure comprising:

a plurality of Composite Right Left Handed (CRLH) magneto-electric unit-cell based structures, where each CRLH magneto-electric unit-cell based structure comprises:

a ground electrode for common electrical contacts;

a first coaxial connector and a second coaxial connector, a first end of the first coaxial connector and a first end of the second coaxial connector connected to the ground electrode;

a first ground surface and a second ground surface connected to a second end of the first coaxial connector and a second end of the second coaxial connector respectively;

a coaxial line included in the second coaxial connector;

a microstrip feed line connected to the coaxial line and electromagnetically coupled with the first and the second ground surfaces; and a first non-resonant meta-surface patch and a second non-resonant meta-surface patch disposed on a dielectric material and placed above a series-capacitor gap between the first ground surface and the second ground surface and electromagnetically coupled to the first ground surface and the second ground surface.

18. The wireless communication device of claim 17, wherein the first coaxial connector includes a second coaxial line.

19. A method of forming an antenna structure comprising:

forming a plurality of Composite Right Left Handed (CRLH) magneto-electric unit-cell based structures, where forming each CRLH magneto-electric unit-cell based structure comprises:

forming a ground electrode for common electrical contacts;

forming a first coaxial connector and a second coaxial connector, a first end of the first coaxial connector and a first end of the second coaxial connector connected to the ground electrode;

forming a first ground surface and a second ground surface connected to a second end of the first coaxial connector and a second end of the second coaxial connector respectively;

forming a coaxial line included in the second coaxial connector;

forming a microstrip feed line connected to the coaxial line and electromagnetically coupled with the first and the second ground surfaces; and forming a first non-resonant meta-surface patch and a second non-resonant meta-surface patch disposed over a dielectric material and placed above a series-capacitor gap between the first ground surface and the second ground surface and electromagnetically coupled to the first ground surface and the second ground surface.

20. The method of claim 19 further comprises forming a second coaxial line included in the first coaxial connector.

* * * * *